United States Patent [19]

Azuma et al.

[11] Patent Number: 4,959,863

[45] Date of Patent: Sep. 25, 1990

[54] SECRET SPEECH EQUIPMENT

[75] Inventors: Mitsuhiro Azuma, Kawasaki; Fumio Amano, Tokyo; Ryota Akiyama, Tokyo; Naoya Torii, Yokohama, all of Japan

[73] Assignee: Fujitsu Limited, Kawasaki, Japan

[21] Appl. No.: 203,300

[22] Filed: Jun. 2, 1988

[30] Foreign Application Priority Data

Jun. 2, 1987 [JP] Japan ..... 62-138732
Feb. 4, 1988 [JP] Japan ..... 63-022895

[51] Int. Cl.[5] ..... H04K 1/04
[52] U.S. Cl. ..... 380/38; 380/49
[58] Field of Search ..... 380/35, 36, 38–40, 380/49

[56] References Cited

U.S. PATENT DOCUMENTS

| | | | |
|---|---|---|---|
| 3,649,915 | 3/1972 | Mildonian, Jr. | 380/35 |
| 3,970,790 | 7/1976 | Guanella | 380/35 |
| 3,970,791 | 7/1976 | Johnson | 380/35 |
| 4,221,931 | 9/1980 | Seiler | 380/35 |
| 4,433,211 | 2/1984 | McCalmont et al. | 380/36 |
| 4,443,660 | 4/1984 | DeLong | 380/36 |
| 4,525,844 | 6/1985 | Scheuermann | 380/38 |
| 4,551,580 | 11/1985 | Cox et al. | 380/38 |
| 4,747,137 | 5/1988 | Matsunaga | 380/9 |
| 4,792,449 | 12/1988 | Virdee et al. | 380/49 |

OTHER PUBLICATIONS

Vaidyanathan, "Quadrature Mirror Filter Banks, M--Band Extensions and Perfect-Reconstruction Techniques", *IEEE ASSP Magazine,* Jul. 1987.

Cox, "The Design of Uniformly and Nonuniformly Spaced Pseudo-Quadrature Mirror Filters", *IEEE Transaction on Acoustics, Speech, and Signal Processing,* vol. ASSP-34, No. 5, Oct., 1986.

Cox et al., "The Analog Voice Privacy System", *AT&T Technical Journal,* 1987.

*Primary Examiner*—Salvatore Cangialosi
*Attorney, Agent, or Firm*—Staas & Halsey

[57] ABSTRACT

Disclosed is a secret speech equipment for ensuring the secrecy of an analog voice signal, and used in voice communication systems such as an analog telephone and mobile radio. The equipment comprises a sub-band signal generating unit for treating input digital samples as frequency-multiplexed signals of voice spectra, to split the frequency-multiplexed signals into a plurality of frequency bands, and thus obtain sub-band signals of the frequency bands, a sub-band signal permutating unit for permuting the sequence of the sub-band signals, and a sub-band signal multiplexing unit for multiplexing the permutated sub-band signals.

15 Claims, 25 Drawing Sheets

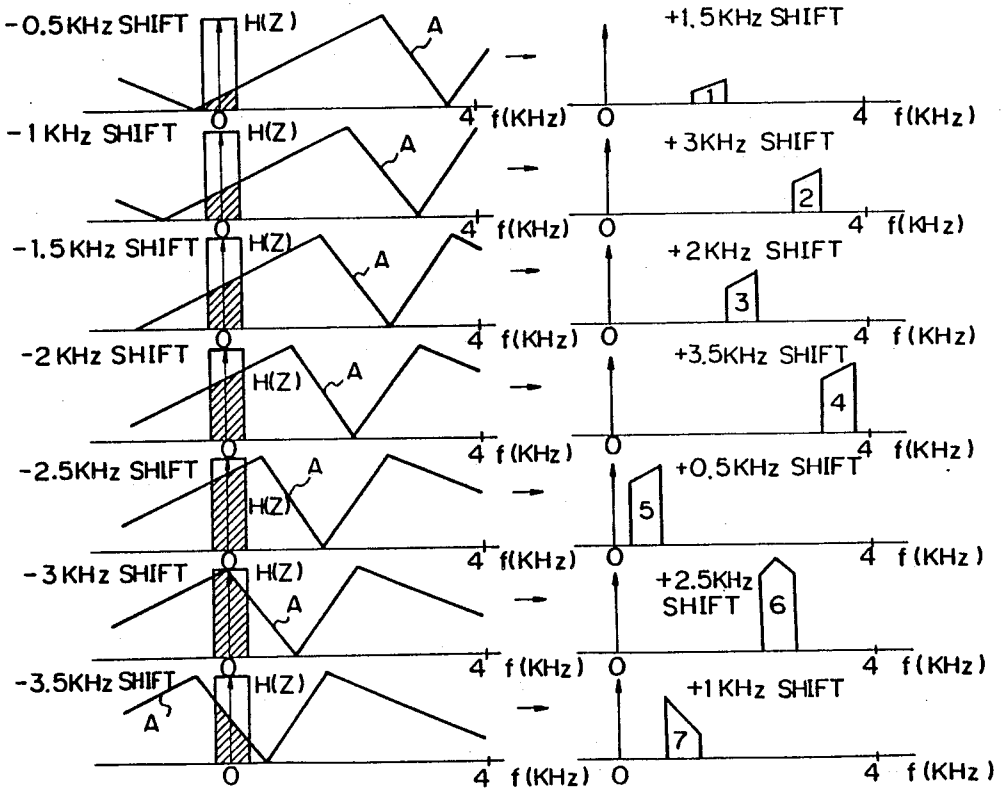
PRIORART
Fig. 3A
Fig. 3B
Fig. 3C
Fig. 3D
Fig. 3E
Fig. 3F
Fig. 3G

INPUT VOICE

SUB-BAND SIGNALS

SCRAMBLED OUTPUT (COMPLEX SIGNAL)

SCRAMBLED OUTPUT (REAL PART)

SECRET SPEECH EQUIPMENT

BACKGROUND OF THE INVENTION (1) Field of the Invention

The present invention relates to secret speech equipment for ensuring the secrecy of analog voice signals, and more particularly, to secret speech equipment for carrying out a band split frequency scrambling after a digital signal processing of the analog voice signal.

Namely, the present invention relates to a speech scrambler or communication security equipment in which input sampling signals are converted into low-speed sampling signals, and the low-speed sampling signals are then subjected to a digital signal processing and frequency split and permutation.

The analog scrambling technology has long been utilized to ensure speech privacy, and this technology is now widely used in voice communication systems utilizing analog channels such as analog telephones and mobile radio systems, but in these voice communication systems, the bandwidth of the scrambled voice should not be allowed to expand, and thus most scrambling technologies provide an unsatisfactory level of security for the scrambled voice: Even if a high level of security can be guaranteed, the quality of the unscrambled voice is not always good and the cost is high.

(2) Description of the Related Art

One type of known conventional analog speech scrambler is a frequency split and permutation equipment. In such a conventional analog speech scrambler, the input speech band is split by analog band-pass filters, and the respective split bands are permutated by converting the frequencies by modulators and by carrying out an inverse conversion by demodulators, and thus the circuit scale is unavoidably enlarged.

Accordingly, in a currently used speech scrambler, an A/D conversion of the input analog signals is carried out, and then a frequency split and permutation are carried out by a digital filter bank.

In a conventional speech scrambler employing such a digital filter bank, since the signal processing rate for each frequency band is equal to the sampling rate of the input signal, a disadvantage occurs in that the number of split bands must be increased and, therefore, the amount of processed signals becomes large when the security level of a cryptogram is raised.

That is, when the number of split or divided bands is increased, to ensure a greater speech secrecy, the number of digital filters must be increased accordingly, and since filters having sharp cutoff characteristics are required, the number of filter taps is increased when the band width is narrowed. As a result, a problem arises in that the total amount of signal processing is increased.

SUMMARY OF THE INVENTION

An object of the present invention is to solve the above-mentioned problems and to provide secret speech equipment employing digital signal processing in which the number of signal processing calculations is decreased even when the number of split bands is increased.

To attain the above object, according to the present invention, there is provided secret speech equipment for ensuring the secrecy of an analog voice signal by using band split frequency scrambling digital samples obtained after digital signal processing of the analog voice signal. This equipment comprises: a sub-band signal generating means, operatively receiving the digital samples, treating the digital samples as frequency-multiplexed voice spectra signals, so as to split the frequency-multiplexed signals into a plurality of frequency bands, and thus obtain sub-band signals of the frequency bands, each of the sub-band signals being placed in a sequence of from a low frequency band to a high frequency band, or vice versa; sub-band signal permutating means, connected to the sub-band signal generating means, for permutating the sequence of the sub-band signals obtained by the sub-band signal generating means; and sub-band signal multiplexing means, connected to the sub-band signal permutating means, for multiplexing the permutated sub-band signals.

Preferably, the sub-band signal generating means comprises: a plurality of bandpass filters; distributing means, connected to the bandpass filters, for distributing the digital samples to the plurality of bandpass filters; and an Inverse Fast Fourier Transformation means, connected to the bandpass filters, for providing different phase information to the outputs of the bandpass filters to obtain respective sub-band signals.

Preferably, the sub-band signal permutating means comprises switching means for permutating the sequence of the sub-band signals in a predetermined order, to output the permutated sub-band signals.

Preferably, the sub-band signal multiplexing means comprises: extracting means for extracting a predetermined band signal from each of the sub-band signals, the extracted band signals being arranged in a sequence from a low frequency band to a high frequency band, or vice versa; delay means, connected to the extracting means, for delaying each of the extracted band signals for a predetermined time; and synthesizing means, connected to the delay means for sequentially synthesizing the delayed signals.

Preferably, the equipment further comprises: control means for controlling the sub-band signal permutating means: random number generating means for generating random numbers at a predetermined time; and a permutation table for storing permutation keys used in the sub-band signal permutating means; the output signal from the random number generating means being a reading address for reading a permutation key from the permutation table, and the read out permutation key being used as an exchange key for the frequency bands.

Preferably, the sub-band signals are complex signals consisting of a real part and an imaginary part, and the equipment further comprises dummy spectrum inserting means for inserting dummy spectra into predetermined frequency bands in the complex signals input to the sub-band signal permutating means.

According to another aspect of the present invention, there is provided secret speech equipment comprising: sub-band signal generating means, operatively receiving the digital samples, for treating the digital samples as frequency-multiplexed voice spectra signals to split the frequency-multiplexed signals into a plurality of frequency bands, to thereby obtain sub-band signals of the frequency bands, each of the sub-band signals being arranged in a sequence of from a low frequency band to a high frequency band, or vice versa; sub-band signal permutating means, connected to the sub-band signal generating means, for permutating the sequence of the sub-band signals obtained by the sub-band signal generating means; sub-band signal multiplexing means, connected to the sub-band signal permutating means, for multiplexing the permutated sub-band signals; control means for controlling the sub-band signal permutating means; random number generating means for generating random numbers at a predetermined time; and a permutation table for storing permutation keys used in the sub-band signal permutating means; the output signal from the random number generating means being a reading address for reading a permutation key from the permutation table, and the read out permutation key being used as an exchange key for the frequency bands.

According to a further aspect of the present invention, there is provided secret speech equipment comprising: sub-band signal generating means, operatively receiving the digital samples, for treating the digital samples as frequency-multiplexed voice spectra signals to split the frequency-multiplexed signals into a plurality of frequency bands, and thereby obtaining sub-band signals of the frequency bands, each of the sub-band signals being arranged in a sequence of from a low frequency band to a high frequency band, or vice versa; sub-band signal permutating means, connected to the sub-band signal generating means, for permutating the sequence of the sub-band signals obtained by the sub-band signal generating means; sub-band signal multiplexing means, connected to the sub-band signal permutating means, for multiplexing the permutated sub-band signals; wherein the sub-band signals are complex signals consisting of a real part and an imaginary part, and the equipment further comprises dummy spectrum inserting means for inserting a dummy spectra into predetermined frequency bands in the complex signals input to the sub-band signal permutating means.

According to a further aspect of the present invention, there is provided secret speech equipment for ensuring speech secrecy by band split frequency scrambling a signal of a predetermined frequency band including a voice band. The equipment comprises: decimating means for decimating input sampling signals into 1/(2n) samples of the input sampling signals, where n is the number of splits of the predetermined frequency band including a voice band; signal output means for converting the 2n output signals, obtained by the decimation by the decimation means, into n frequency band signals, and for outputting the n frequency band signals; permutating means for receiving, sequentially in a space domain, the n frequency band signals from the signal output means, and for changing the order of the received n frequency band signals to provide permutated output signals sequentially in a frequency domain; frequency band signal extracting means for extracting each frequency band signal from each of the permutated output signals; and interleaving means for multiplexing and synthesizing the extracted frequency band signals.

Preferably, the signal output means is a complex signal output means including polyphase filters and an Inverse Fast Fourier Transformer, for converting the 2n output signals obtained by the decimating means into n complex frequency band signals having a real part and an imaginary part; the permutating means is a means for permutating the complex frequency band signals; the frequency band signal extracting means is a means for extracting each frequency band signal from each of the permutated complex frequency band signals; and the interleaving means is a means for multiplexing and synthesizing the extracted complex frequency band signals.

According to a still further aspect of the present invention, there is provided secret speech equipment for ensuring speech secrecy by band split frequency scrambling a signal of a predetermined frequency band including a voice band. The equipment comprises: decimating means for decimating input sampling signals into 1/(2n) samples of the input sampling signals, where n is the number of splits of the predetermined frequency band including a voice and; signal output means for converting the 2n output signals, obtained by the decimation by the decimation means, into n frequency band signals, and for outputting the n frequency band signals; permutating means for receiving, sequentially in a frequency domain, the n frequency band signals from the signal output means, and for changing the order of the received n frequency band signals to provide permutated output signals sequentially in a frequency domain; frequency band signal extracting means for extracting each frequency band signal from each of the permutated output signals; interleaving means for multiplexing and synthesizing the extracted frequency band signals; the signal output means being a complex signal output means including polyphase filters and an Inverse Fast Fourier Transformer, for converting the 2n output signals obtained by the decimating means into n complex frequency band signals having a real part and an imaginary part; the permutating means being a means for permutating the complex frequency band signals; the frequency band signal extracting means being a means for extracting each frequency band signal from each of the permutated complex frequency band signals; and the interleaving means being a means for multiplexing and synthesizing the extracted complex frequency band signals.

According to a still further aspect of the present invention, there is provided secret speech equipment for ensuring the secrecy of an analog voice signal by band split frequency scrambling digital samples obtained after a digital signal processing of the analog voice signal. The equipment comprises: decimation means for sequentially incorporating every 2n samples of input sampling signal having a period T and for forming 2n time sequences of sampling signals each having a period 2T; 2n first polyphase filters for receiving an output of the decimation means, for passing one of the n-split frequency bands of the voice signal; a first Inverse Fast Fourier Transformer for changing the phase characteristics of the outputs of the polyphase filters to obtain complex signals each being a 2n-multiplexed signal of the corresponding frequency band; permutating means for permutating, on the frequency domain, the frequency bands of the complex signals; a second Inverse Fast Fourier Transformer for applying an operation, converse to that in the first Inverse Fast Fourier Transformer, on the outputs of the permutating means; second polyphase filters having substantially the same characteristics as the first polyphase filters, for processing the outputs of the second Inverse Fast Fourier Transformer to output signals of the respective frequency bands; and interleaving means for multiplexing and synthesizing the signal of the respective frequency bands obtained at the output of the second polyphase filters.

BRIEF DESCRIPTION OF THE DRAWINGS

The above objects and features of the present invention will be more apparent form the following description of the embodiments with reference to the drawings, wherein:

FIGS. 3A to 3G are diagrams explaining the operation of the conventional equipment shown in FIG. 2;

DESCRIPTION OF THE PREFERRED EMBODIMENTS

The present invention proposes a new band split frequency scrambler utilizing the T-MUX (Transmultiplexer) technology, which makes it possible to minutely and effectively split the voice signal band into sub-bands by means of fewer signal processings. This technology is also used to produce scrambled signals for which a high level of security can be provided by permutation and synthesizing the sub-bands.

Unscrambled voice signals are also obtained by the same method as used in the scrambler, but the quality of the signals does not depend so much on the channel characteristics. When implementing this hardware, one DSP (Digital Signal Processor) chip is capable of carrying out a band splitting scrambler processing of 25 sub-bands, and thus this type of processing is relatively economical.

The following description describes the principle, the configuration, the level of security, and the unscrambled voice quality of the T-MUX scrambler according to the embodiments of the present invention.

For a better understanding of the present invention, the background of the invention, conventional secret speech equipment, and the problems therein, will be first described with reference to FIGS. 1 to 4.

Figure 1:
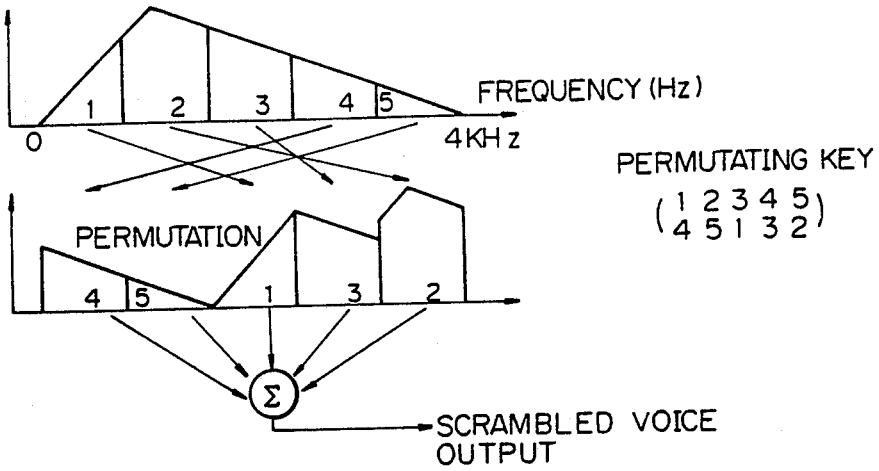
FIG. 1 is a diagram explaining a band split frequency scrambling method background for the present invention.

FIG. 1 shows a band split frequency scrambling method, as background to the present invention.

In FIG. 1, on the scrambler side, in the 4 kHz voice band the sub-bands 1 to 5 are permutated at random, synthesized, and output to channels as scrambled voice. On the unscrambler side, a processing similar to that of the scrambler side is performed, but the permutation process is the reverse of that of the scrambling process. In this process, permutation is carried out through the keys of the scrambler, and is determined beforehand between the transmitting and receiving side. The scrambled voice signals on the channel should have the following features.

(1) The bandwidth should not be expanded.
(2) As the sub-bands are permutated at random, the spectra thereof should be uniformly distributed.
(3) The voice intonation envelope should be retained.
(4) The security level of the scrambling should become stronger as the number of sub-bands is increased.

Problem with Conventional Methods

Conventional band splitting scramblers are characterized by their band splitting methods, and can be roughly classified into two types.

(a) The voice band is decomposed into signal spectrum coefficients using a Fast Fourier Transformer (FFT), and the coefficients are permutated.
(b) The voice band is split into sub-bands by a digital filter and the sub-bands are permutated.

In method (a), the use of FFT's makes it possible to split a band into many small segments, but the unscrambled voice is critically affected by the channel characteristics, especially by group delay, and become unpleasant to listen to because of the FFT frame noise. In addition, a frame synchronization error by the FFT scrambler will greatly reduce the quality the unscrambled voice of i.e., the system requires synchronization within only one sample (125 sec) between the scrambler and the unscrambler. To prevent this noise, an expensive automatic channel equalizer or a synchronous circuit must be provided, which increases the size and cost of the equipment.

In method (b), assuming a suitably sized unit (for example, a desk-top unit) is used and the digital filters use LSI's, a band can not be split into more than ten sub-bands. Recently, a method of making a digital filter programmable by using DSP has been considered, but the equipment can not be made smaller than the proprietary hardware.

Figure 2:
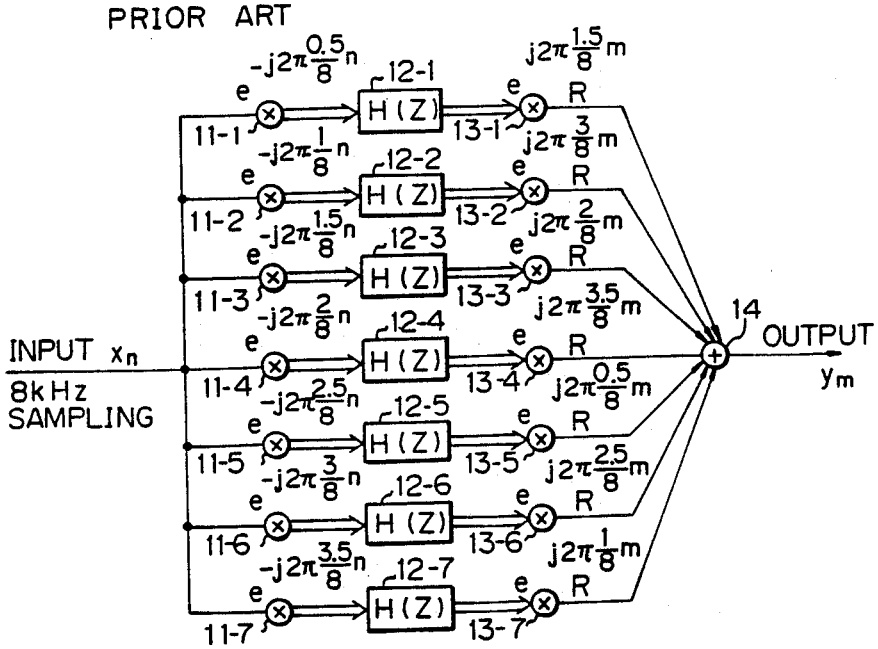
Fig. 2 PRIOR ART
FIG. 2 is a block diagram of a conventional frequency-split scrambling equipment.

FIG. 2 shows a conventional digital signal processing type frequency-split scrambler which overcomes the drawback of the above-mentioned analog equipment. In FIG. 2, numerals 11-1 to 11-7 represent complex multipliers, 12-1 to 12-7 digital filters such as Finite Impulse Response (FIR) type digital filters, 13-1 to 13-7 complex multipliers, and 14 an adder.

An analog input signal is sampled at, for example, 8 KHz, to prepare A/D converted digital signals of a series of input samples x(n), which are inputted into the multipliers 11-1, 11-2, . . . and 11-7 to multiply the samples by phase shifting parameters $e^{-j2\pi(0.5/8)n}$, $e^{-j2\pi(\frac{1}{8})n}$, . . . and $e^{-j2\pi(3.5/8)n}$, respectively. The results are inputted to the digital filters 12-1, 12-2, . . . and 12-7.

Outputs of the digital filters 12-1, 12-2, . . . and 12-7 are inputted to the multipliers 13-1, 13-2, . . . and 13-7, and are multiplied by phase shifting parameters $e^{j2\pi(1.5/8)m}$, $e^{j2\pi(\frac{3}{8})m}$, . . . and $e^{j2\pi(1.8)m}$ respectively. Then, real components in the outputs of the multiplied results are summed in the adder 4 to obtain an output ym.

The operation of the frequency-band splitting and scrambling equipment shown in FIG. 2 will be described with reference to FIGS. 3A to 3G. The left-hand side of FIGS. 3A to 3G show a speech spectrum signal A (namely, inputs xn) which has been coded as a complex signal and shifted by the multipliers 11-1 to 11-7. Also at left-hand side, the hatched portions represent bands to be taken out by the digital filters 12-1 to 12-7. The right-hand side of the figure shows spectra to be transposed, taken out by the digital filters 12-1 to 12-7 and shifted by the multipliers 13-1 to 13-7. The same system function H(z), i.e., the transfer function H(z), is used for the digital filters 12-1 to 12-7.

For example, the speech spectrum signal A is multiplied by $e^{-j2\pi(0.5/8)n}$ in the multiplier 11-1 in FIG. 2, and thus is shifted by −0.5 kHz, as shown on the left-hand side of FIG. 3A. Then, the digital filter 12-1 in FIG. 2 outputs the frequency band of the hatched portion in FIG. 3A, and the frequency band output from the digital filter 12-1 is multiplied by $e^{j2\pi(1.5/8)m}$ in the multiplier 13-1 to become a spectrum component 1 shifted by +1.5 kHz, as shown on the right-hand side of FIG. 3A.

Similarly, the speech spectrum signal A is multiplied by $e^{-j2\pi(\frac{1}{8})n}$ in the multiplier 11-2, and thus is shifted by −1 kHz, as shown on the left-hand side of FIG. 3B. Then, the digital filter 12-2 outputs the frequency band of the hatched portion of FIG. 3B, and the frequency band output from the digital filter 12-2 is multiplied by $e^{j2\pi(\frac{3}{8})m}$ in the multiplier 13-2 to become a spectrum component 2 shifted by +3 kHz, as shown on the right-hand side of FIG. 3B. In this way, as shown on the right-hand side of the figure, shifted spectrum components 3 to 7 are obtained and summed in the adder 4, thus achieving the frequency-band splitting and scrambling operation as shown in FIG. 2B.

Nevertheless, in the above-mentioned conventional secret speech equipment using this digital signal processing, a bank of digital filters is used and thus, if the number of divided bands is increased to ensure a greater speech secrecy, the number of digital filters must be increased accordingly, as mentioned before.

To overcome the drawbacks in the above-mentioned conventional digital processing type secret speech equipment, the inventors of the present invention carried out an investigation of a known T-MUX (transmultiplex) technology. The T-MUX technology is applied for frequency multiplexing processing in the field of communication systems using a telephonic service (see, for example, "Application of Digital Signal Processing" third edition, issued on July 10, 1983, pp 121–134, an Institution of Electronic Information and Communication Engineers of Japan). In the T-MUX, a TDM-FDM converter and an FDM-TDM converter are used for mutually converting a time-division multiplexing (TDM) signal and a frequency-division multiplexing (FDM) signal. The T-MUX will be described with reference to FIG. 4.

Figure 4:
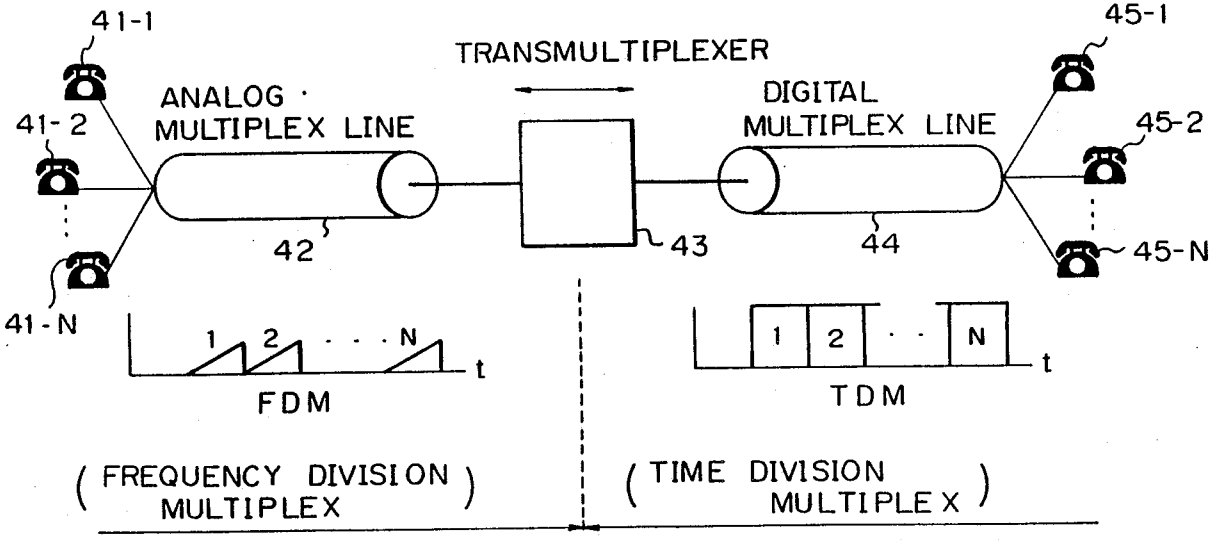
Fig. 4 PRIOR ART
FIG. 4 is a diagram of a transmultiplex technology.

In FIG. 4, analog terminal instruments such as telephones 41-1, 41-2, . . . , and 41-N are connected to an analog multiplex line 42 through which the analog signals from the telephones 41-1, 41-2, . . . , and 41-N are transmitted by frequency division multiplexing (FDM). The frequency-division multiplexed signals are then converted to a time-division multiplexed (TDM) signal by a transmultiplexer 43. The TDM signal is then transmitted through a digital multiplexed line 44 to telephones 45-1, 45-2, . . . , and 45-N, which thus receive data of respective time slots 1, 2, . . . , and N. A communication from the telephones 45-1 through 45-N to the telephones 41-1 through 41-N is effected in reverse to the way described above.

Based on the above-mentioned T-MUX technology, the inventors of the present invention created the original concept of the present invention, which will be described with reference to FIGS. 5 to 10.

Figure 5:
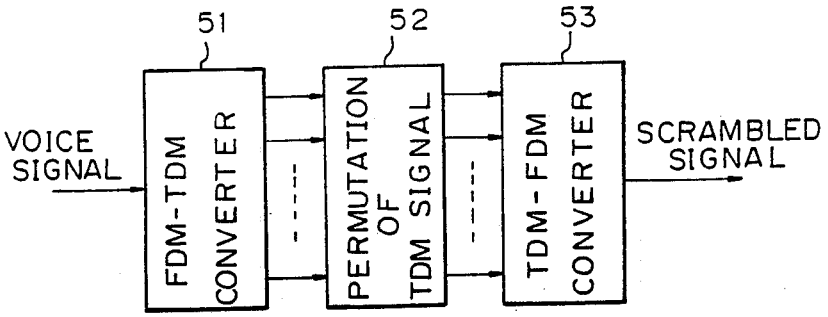
FIG. 5 is a block diagram of a device showing the original concept of the present invention.

FIG. 5 is a block diagram illustrating a device showing the original concept of the present invention. In FIG. 5, the input voice analog signal is considered to be a frequency-multiplexed signal, and the input frequency-multiplexed signal is converted by a converter 51 into a TDM signal. The time slots in the TDM signal are then exchanged, i.e., permutated, in accordance with a predetermined key, the permutated signal is converted into an FDM signal, and thus a scrambled signal is obtained.

Figure 6:
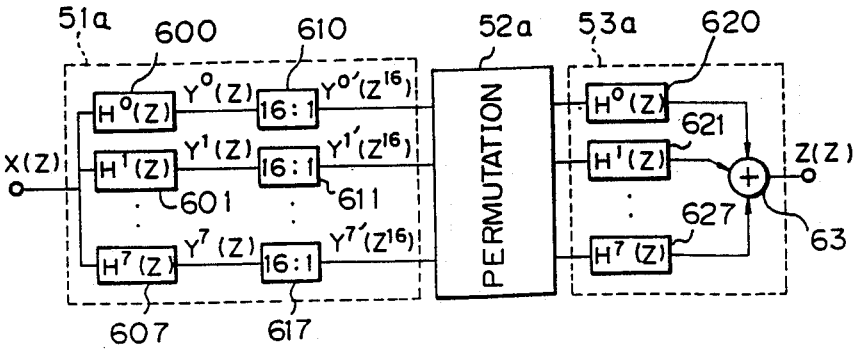
FIG. 6 is a block diagram of an example of a device employing the concept of FIG. 5.

FIG. 6 shows a device employing the concept shown in FIG. 5. In FIG. 6, an FDM-TDM converter 51*a*, which is displaced by the FDM-TDM converter 51 in FIG. 5, consists of polyphase filters ($H^0(z)$ to $H^7(z)$) 600 to 607 and decimation portions 610 to 617, decimating one of 16 consequent samples. A TDM-FDM converter 53*a*, which is displaced by the TDM-FDM converter 53, consists of polyphase filters ($H^0(z)$ to $H^7(z)$) 620 to 627 and an adder 63.

FIGS. 7A to 7J illustrate frequency spectra at each point in FIG. 6, and frequency characteristics of the filters in the device shown in FIG. 6.

Figures 7A, 7B, 7C, 7D, 7E, 7F, 7G, 7H, 7I, 7J:
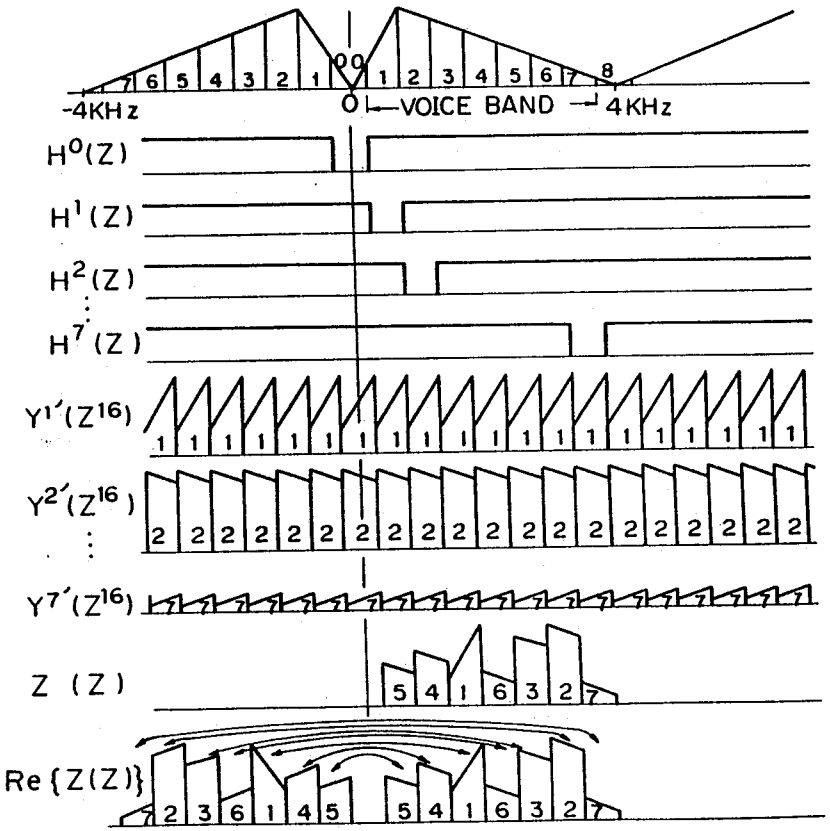
FIGS. 7A to 7J are diagrams of frequency spectra at each point in the device shown in FIG. 6.

In FIGS. 6 and 7A to 7J, each sample of the input sampling series X(z) can be expressed by a spectrum having a voice band ranging from 0 to 4 kHz, as shown in FIG. 7A. The voice band is assumed to be a frequency-multiplexed signal having sub-bands 0 to 8, and the frequency-multiplexed signal is inputted to the filters $H^0(z)$ to $H^7(z)$ so that the signal is respectively passed therethrough, as shown in FIGS. 7B to 7E. Accordingly, in this example, the voice band of 4 kHz is split into eight small sub-bands having the same bandwidth. Then, the sampling signal sequences of each filter output (hereinafter called channels) are decimated at every 16 samples and the decimated samples are used as sub-band signals. As a result, as shown in FIGS. 7F to 7H, the decimated sub-bands align as complex signals on the frequency domain of each channel. The decimated complex signals are, as shown in FIGS. 7F to 7H, repeating signals on the frequency domains of respective channels. Note that channel 0 is not illustrated in the figure because it is not necessary for a voice band.

Figure 8:
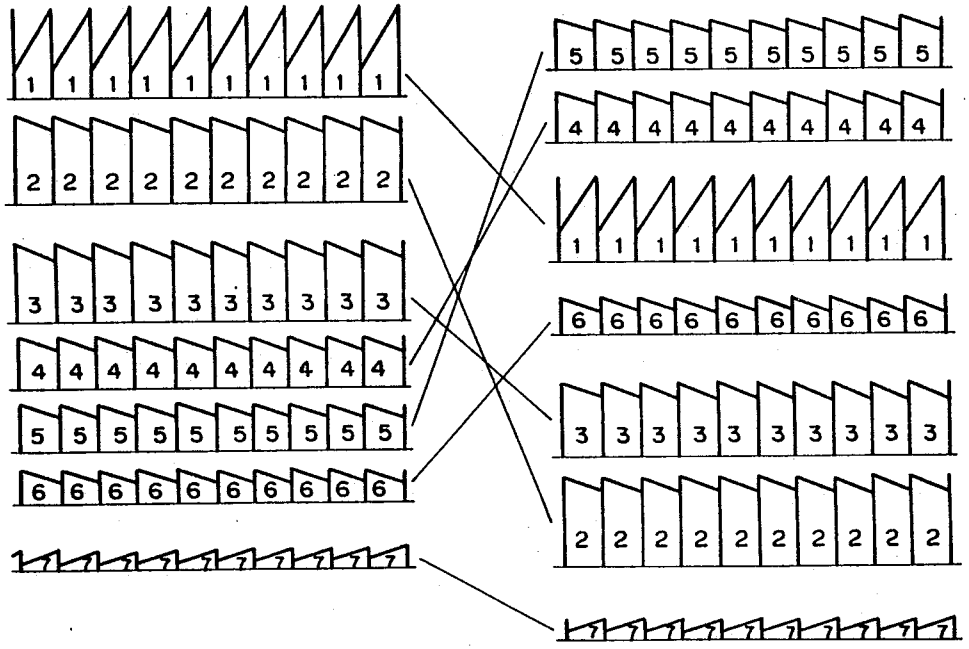
FIG. 8 is a diagram explaining the permutation in the device shown in FIG. 6.

After permutating these channels in accordance with a predetermined permutation key, as shown in FIG. 8, the permutated signals are inputted to the polyphase filters $H^0(z)$ 620 to $H^7(z)$ 627 in the TDM-FDM converter 53*a* shown in FIG. 6, the signals passed through these polyphase filters are synthesized by the adder 14, and as a result, a scrambled signal Z(z) is obtained at the output of the adder 63, as shown in FIG. 7I. The spectrum of the real part of the complex signal Z(z) is, as shown in FIG. 7J, a signal symmetrically folded with respect to the frequency 0.

Figure 9:
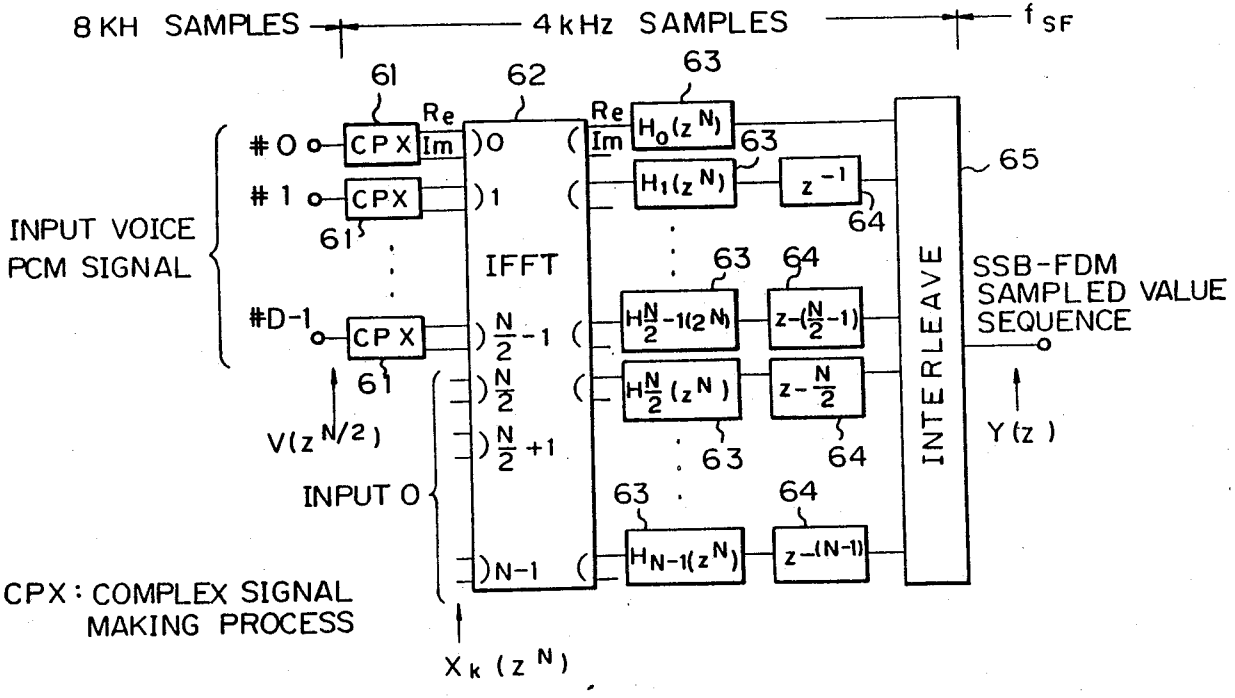
Fig. 9 PRIOR ART
FIG. 9 is a block diagram of a conventional example of the TDM-FDM converter shown in FIG. 5.

As a practical example of the constitution of the FDM-TDM converter 53, a circuit realized by combining an Inverse Fast Fourier Transformer (IFFT) and polyphase filters is known, as proposed by Bellanger in 1974. The Bellanger TDM-FDM is shown in FIG. 9. A circuit in which the input and the output are the reverse to those of the TDM-FDM converter shown in FIG. 9, can be used as the FDM-TDM converter 51.

In FIG. 9, the CPX 61 is a complex signal forming unit for forming the input PCM voice signal into a complex signal having a real part and an imaginary part and for getting a single side band signal, the N-point IFFT 62 is an Inverse Fast Fourier Transformer for converting frequency characteristic of the original filter, $H_0(Z^N)$ to $H_{N-1}(Z^N)$63 are polyphase filters, $Z^{-1}$ to $Z^{-(N-1)}$63 are delay elements, and 65 is an interleave unit for synthesizing the sub-bands.

It should be noted that the CPX 61 for complex signal formation can be omitted when the Bellanger circuit is applied to the constitution of the circuit shown in FIG. 6, because the outputs $Y^{0'}(Z^{16})$, $Y^{1'}(Z^{16})$, . . . , and $Y^{7'}(Z^{16})$ are complex signals.

FDM-TDM translation

It will now be assumed that the Bellanger TDM-FDM converter shown in FIG. 9 is applied to the TDM-FDM converter 53 shown in FIG. 5, and that the polyphase filters $H^0(Z)$ to $H^7(Z)$ in the front stage have the same characteristics as those of the polyphase filters $H^0(Z)$ to $H^7(Z)$ in the rear stage of a permutation portion 52*a*. The original filter $H^0(Z)$ is indicated by a transfer function H(Z), as follows $$H(Z) = \sum_{m=0}^{15} Z^{-m} H_m(Z^{16}) \tag{1}$$

where Z denotes exp(j2πf/8) and Hm is a polyphase sub-filter.

Based on the original filter $H^0(Z)$, the polyphase filters $H^1(Z)$ to $H^n(Z)$ are formed.

In this case, the filtering band of each fub-filter Hm is shifted by one bandwidth, which means that Z undergoes the conversion Zexp(j2πi/16). To shift the filter characteristic to the i-th sub-band, the following equation is obtained, $$H^i(Z) = \sum_{m=0}^{15} \exp(j2\pi im/16) Z^{-m} H_m(Z^{16}) \tag{2}$$

and when the Z-transformation of an input signal is represented as X(Z), the following equation is obtained.

$$X(Z) = \sum_{m=0}^{15} Z^{-n} X_n(Z^{16}) \tag{3}$$

Therefore, the filter output $Y^i(Z)$ (i=0, 1, 2, . . . , 7) is obtained from the following equation.

$$\begin{aligned} Y^i &= H^i(Z) \cdot X(Z) \\ &= \sum_{m=0}^{15} \exp\left(j2\pi \frac{im}{16}\right) Z^{-m} \sum_{n=0}^{15} Z^{-n} H_m(Z^{16}) X_n(Z^{16}) \\ &= \sum_{m=0}^{15} \sum_{n=0}^{15} \exp(j2\pi im/16) Z^{-(m+n)} H_m(Z^{16}) X_n(Z^{16}) \end{aligned} \tag{4}$$

The signal $Y^{i'}(z)$ which decimated $Y^i(Z)$ 16-fold is expressed as follows, when n=15−m is substituted therefor.

$$Y^{i'} = \sum_{n=0}^{15} \exp(j2\pi im/16) Z^{-15} H_m(Z^{16}) X_{(15-m)}(Z^{16}) \tag{5}$$

If W=exp(−j2π/16), the equation (5) can be expressed by the following matrix form.

$$\begin{bmatrix} Y^{0'} \\ Y^{1'} \\ \cdot \\ \cdot \\ \cdot \\ Y^{15'} \end{bmatrix} = \underbrace{\begin{bmatrix} 1 & 1 & \cdots & 1 \\ 1 & W^{-1} & \cdots & W^{-15} \\ \cdot & \cdot & \cdot & \cdot \\ \cdot & \cdot & \cdot & \cdot \\ \cdot & \cdot & \cdot & \cdot \\ 1 & W^{-15} & \cdots & W^{-15\cdot 15} \end{bmatrix}}_{\text{IFFT}} \begin{bmatrix} H_0 & & & \\ & H_1 & & \\ & & \ddots & \\ & & & H_{15} \end{bmatrix} \underbrace{\begin{bmatrix} X_{15} \\ X_{14} \\ \cdot \\ \cdot \\ \cdot \\ X_0 \end{bmatrix}}_{\text{Input inverse order}} \tag{6}$$

Permutation of a Sub-band Signal

The decimated signal sequence (signal vector) $Y^{i'}(Z^{16})$ is permutated by a multiplication by the permutation matrix [T] of 8×8. In this case, the row element of the permutation matrix is 0 or 1 (the sum being 1), and element of this matrix is 0 or 1 (the sum being 1). The permutation matrix is a fixed permutation if constant with time, and a variable permutation if variable. In the scramble processing, the rows of this matrix are permutated at random, and the number of combinations is usually n! for an n×n matrix.

TDM-FDM translation

This translation is carried out in the TDM-FDM converter 51 shown in FIG. 5. A series of $Y^{i'}(Z)$ (which was permuted by the permutation matrix) is again split into sub-bands through the band splitting filters ($H^0$ to $H^7$) 620 to 627. In this process, all the components of 4 kHz to 8 kHz are made zero.

The real part of Z(Z) becomes a scrambled voice output, through the final synthesis processing, and these processes can be expressed by the following equation.

$$\begin{aligned} Z(Z) &= \sum_{l=0}^{7} H^l(Z) Y^{l'}(Z^{16}) \\ &= \sum_{l=0}^{7} \sum_{m=0}^{7} \exp\left(j2\pi \frac{lm}{16}\right) Y^{l'}(Z^{16}) Z^{-m} H_m(Z^{16}) \\ &= \sum_{m=0}^{15} Z^{-m} H_m(Z^{16}) \left\{ \sum_{l=0}^{7} \exp(j2\pi lm/16) Y^{l'}(Z^{16}) \right\} \end{aligned} \tag{8}$$

If $W=\exp(-j2\pi/16)$, the equation (7) can be expressed by the following matrix form.

$$\begin{bmatrix} Z^0 \\ Z^1 \\ \cdot \\ \cdot \\ \cdot \\ Z^{15} \end{bmatrix} = \begin{bmatrix} H_0 & & & \\ & H_1 & & \\ & & \ddots & \\ & & & H_{15} \end{bmatrix} \underbrace{\begin{bmatrix} 1 & 1 & \cdots & 1 \\ 1 & W^{-1} & \cdots & W^{-15} \\ \cdot & \cdot & & \cdot \\ \cdot & \cdot & & \cdot \\ \cdot & \cdot & & \cdot \\ 1 & W^{-15} & \cdots & W^{-15\cdot 15} \end{bmatrix}}_{\text{IFFT}} \begin{bmatrix} Y^{0'} \\ Y^{1'} \\ \cdot \\ \cdot \\ \cdot \\ Y^{7'} \\ 0 \\ \cdot \\ \cdot \\ \cdot \\ 0 \end{bmatrix} \tag{8}$$

The above equations (1) to (8) correspond to the states shown in FIGS. 7B to 7I.

Based on the above-described considerations, the embodiments of the present invention will now be described as follows.

Figure 10:
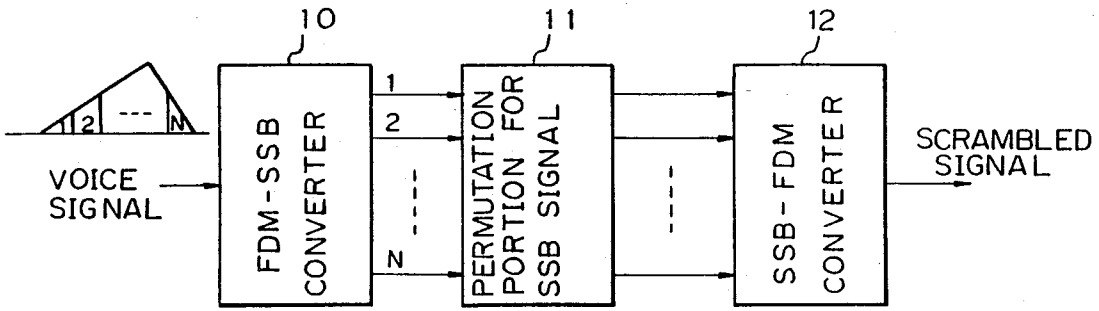
FIG. 10 is a block diagram illustrating a principle of a band split frequency scrambling type secret speech equipment according to the present invention.

FIG. 10 shows a principle of the present invention. In FIG. 10, the digital signal processing secret speech system of the present invention comprises an FDM-SSB converter 1 for converting frequency-division-multiplexing (FDM) signals into sub-band signals (SSB), an SSB signal permutation portion 11 for permutating a plurality of the SSB signals outputted from the FDM-SSB converter 10, and an SSB-FDM converter 12 for converting the thus permutated SSB signals into FDM signals.

According to the present invention, an input speech spectrum signal such as the signal shown in FIG. 1, for example, is considered to be a frequency-multiplexed signal comprising, for example, frequency bands 1 to N. The FDM-SSB converter 10 picks SSB signals out of the bands 1 to N and the positions of the SSB signals of the bands 1 to N are permutated as shown in FIG. 1, for example, by the SSB signal permutation portion 11. Under this permutated state, the SSB-FDM converter 12 prepares an FDM signal which is output as a secret speech signal.

In this case, similar to the transmultiplexer (T-MUX) technology, a fast Fourier transform may be used for the FDM-to-SSB conversion or for the SSB-to-FDM conversion. In addition, a decimation process may be carried out to remarkably reduce the total amount of signal processing.

It should be noted that the SSB signals used in the T-MUX technology must be distinguished from the usual single side band signal, in the field of analog modulation. Namely, each of the SSB signals in the T-MUX technology is a split sub-band derived from a voice band of 4 kHz. Therefore, in the following description, the SSB signals used in the T-MUX technology are referred to as sub-band signals.

Figure 11:
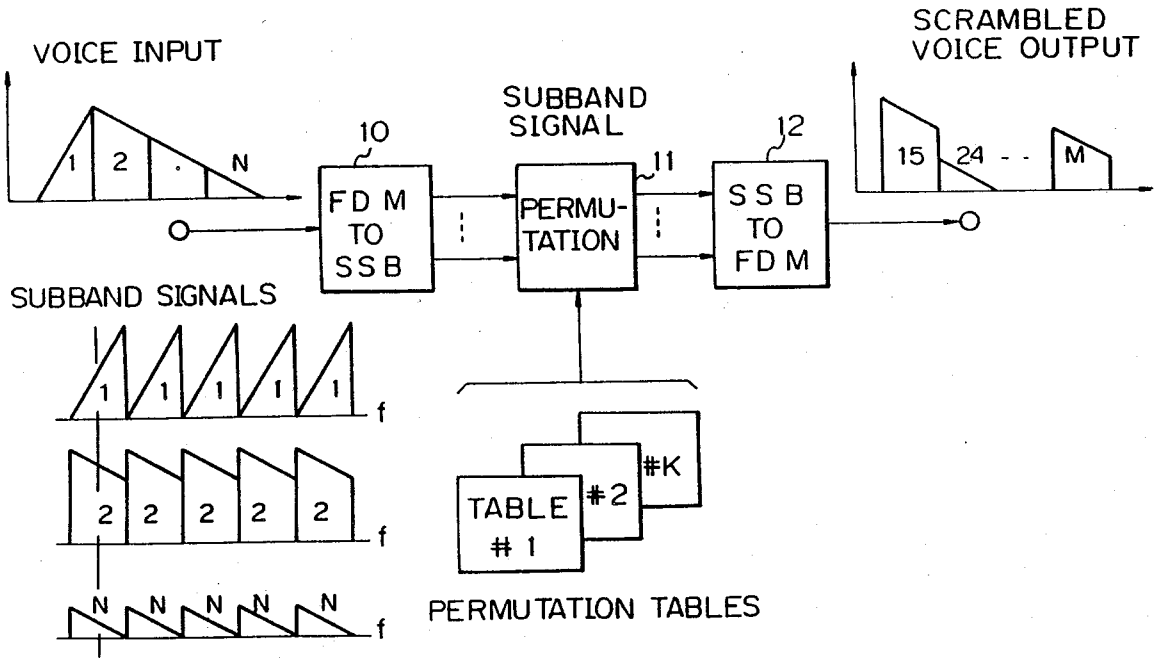
FIG. 11 is a diagram illustrating a principle of the transmultiplex scrambler applicable to the equipment shown in FIG. 10.

FIG. 11 shows a principle of the T-MUX scrambler, which has substantially the same circuit configuration as that shown in FIG. 10. As shown in FIG. 11, the voice input band is split into N sub-bands by the FDM-SSB converter 10, the N sub-bands are permutated in accordance with permutation tables #1, #2, . . . , and #K, the permuted sub-bands are then converted to an FDM signal by the SSB-FDM converter 12, and as a result, a scrambled voice output is obtained.

When comparing the original concept of the invention shown in FIG. 5 and the principle of the invention shown in FIG. 10, it is noted that, in the present invention, the input FDM signal need not be converted into a TDM signal, but merely converted into SSB signals.

Figure 12:
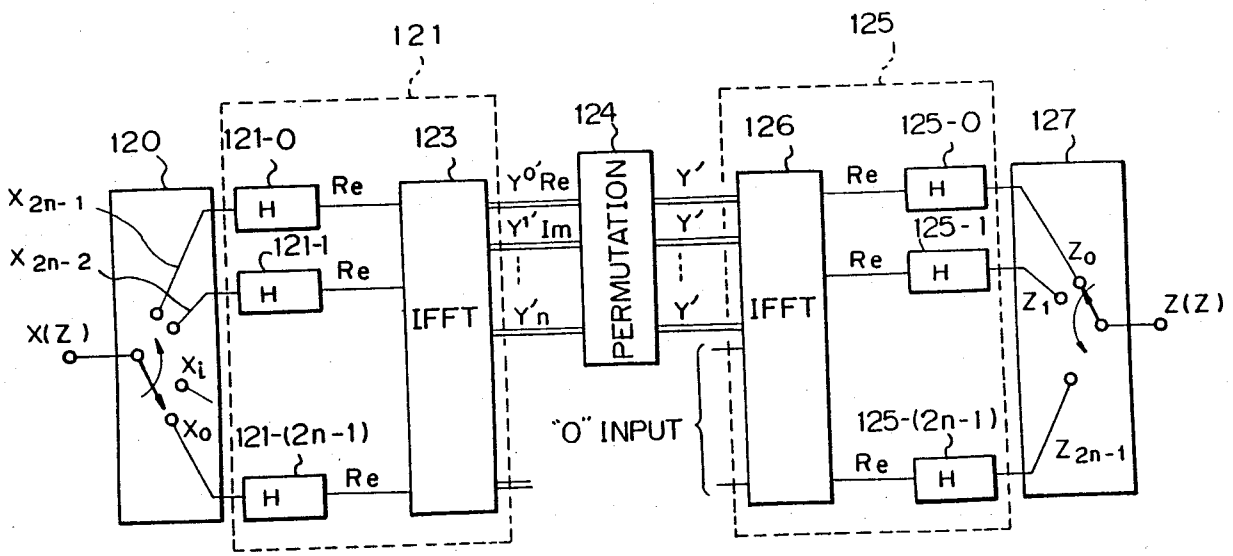
FIG. 12 is a block diagram illustrating a basic structure of a band split frequency scrambling type secret speech equipment according to the present invention.

FIG. 12 shows a basic structure of the present invention, which is a development of the circuit configuration based on the principle shown in FIG. 10.

FIG. 12 shows secret speech equipment for ensuring the secrecy of an analog voice signal by splitting and permutating a predetermined frequency band signal including a voice band. It is assumed that the number of splits in the predetermined frequency band including the voice band is n.

The secret speech equipment according to the basic structure of the present invention includes a decimation unit 120, a complex signal output unit 121 consisting of polyphase filters 121-0 to 121-(2n-1) and an Inverse Fast Fourier Transformer 123, a permutation unit 124, frequency band signal extracting means 125 including an Inverse Fast Fourier Transformer 126 and polyphase filters 125-0 to 125-(2n-1), and an interleaving unit 127.

The decimation unit 120 cyclically distributes the 2n samples $X_0, \ldots, X_i, \ldots$, and $X_{2n-1}$ of the input sampling signal X(Z) to the polyphase filters 121-(2n-1), . . . , 121-1, and 121-0, respectively, and therefore, each of the polyphase filters 121-0, 121-1, . . . , and 121-(2n-1) receives decimated signals which are ½n of the input sampling signal. The order of distribution in the polyphase filters is from the bottom to the top.

The polyphase filters 121-0, 121-1, . . . , and 121-(2n-1) and the IFFT 123 convert the decimated 2n output signals into n complex signals $Y_0'$, $Y_1'$, . . . , and $Y_n'$ having respective frequency bands.

The permutation unit 124 permutates the frequency bands of the complex signals, the IFFT 126 and the polyphase filters 125-0, 125-1, . . . , and 125-(2n-1) extract respective frequency-band signals from the permutated complex signals, and the interleaving unit 127 multiplexes or synthesizes the resulted frequency-band signals.

The decimation unit 120 decimates the input sampling signal to a lower speed sampling signal. The frequency bands of the complex signals, which are the outputs of the complex signal output unit 121, are permutated in the permutation unit 124 so that the secrecy operation is performed. Each frequency band signal after the permutation is extracted and synthesized by the frequency-band output unit 125, and then multiplexed by the interleaving unit 127.

Figure 13:
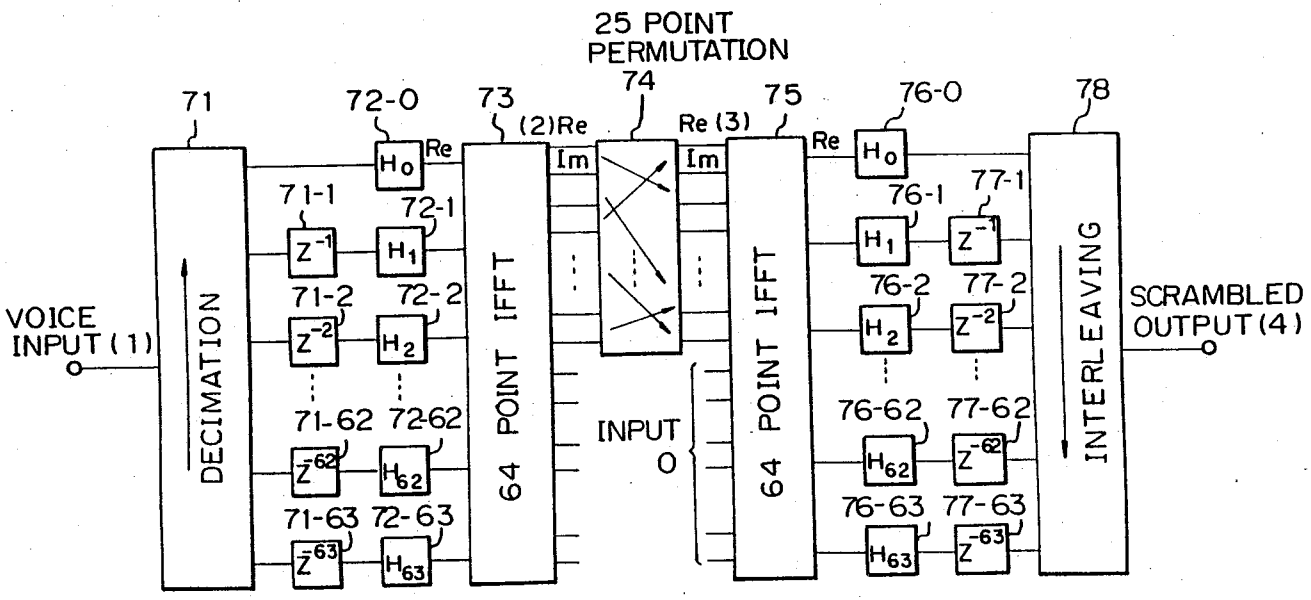
FIG. 13 is a block diagram illustrating a first embodiment of the present invention.

FIG. 13 is a block diagram illustrating a band split frequency scrambling secret speech equipment according to a first embodiment of the present invention.

In FIG. 13, 71 is a decimation unit for decimating an input sampling sequence of 8 kHz, to output 64 channels of outputs each having a sampling sequence of 8 kHz/64=125 Hz; 71-1 to 71-63 are delay elements $Z^{-1}$ to $Z^{-63}$ for delaying the phases of the sampling sequences of the respective channels output from the decimation unit 71, to coincide the phases with each other; 72-0 to 72-63 are polyphase filters ($H_0$ to $H_{63}$) for passing respective sub-bands in the voice band; 73 is a 64-point IFFT; 74 is a 25-point permutation unit; 75 is a 64-point IFFT; 76-0 to 76-63 are polyphase filters ($H_0$ to $H_{63}$); 77-1 to 77-63 are delay elements ($Z^{-1}$ to $Z^{-63}$); and, 78 is an interleaving unit for synthesizing the scrambled outputs.

The above-mentioned decimating process effects a distributing function for distributing the input samples to all of the polyphase filters.

The operation of the device shown in FIG. 13 will be described with reference to the waveform diagrams shown in FIGS. 14A to 14D.

Figures 14A, 14B, 14C, 14D:
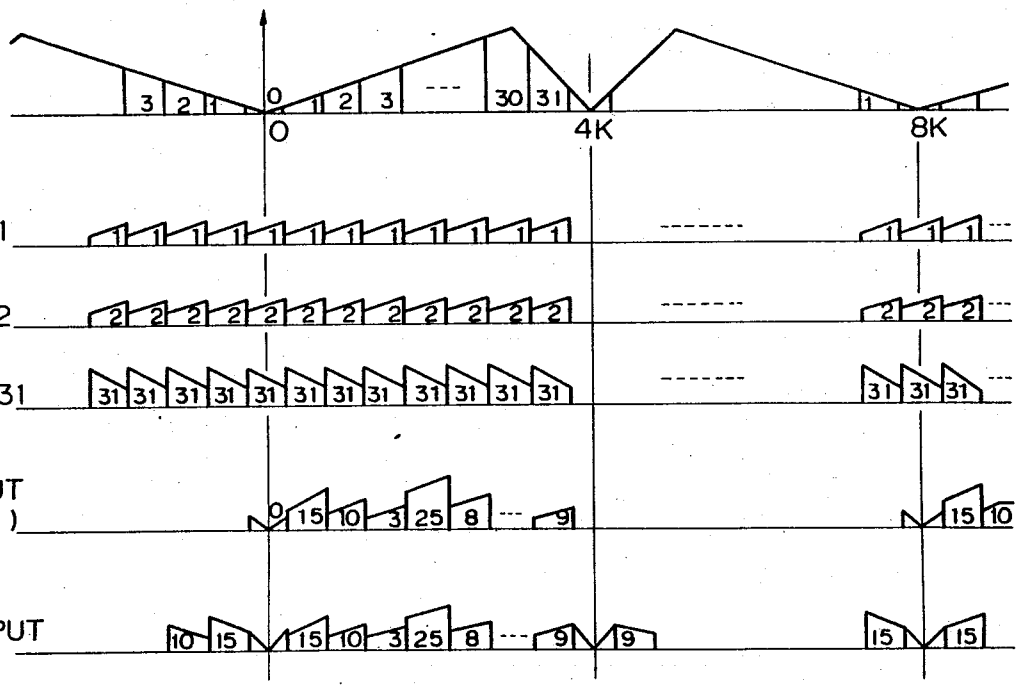
FIG. 14A to 14D are waveform diagrams explaining the operation of the equipment shown in FIG. 13.

The voice signal inputted to the decimation unit 71 is a sampling signal sampled by a frequency of 8 kHz, which is twice that of the voice band, according to the Nyquist sampling theorem. Each of the sampling signals has, as shown in FIG. 14A, a spectrum distribution which is a repetition of a frequency arrangement ranging from 0 to 8 kHz. In this embodiment, the voice band is deemed to be split into 32 sub-bands 0 to 31 and accordingly, there are 64 sub-bands in the frequency range from 0 to 8 kHz.

If the signal processing speed in the device is the same as the sampling frequency of 8 kHz of the input voice signal, the amount of signals to be processed in each unit would become extremely large, and therefore, according to this embodiment, the input sampling signal of 8 kHz is converted into 64 low-speed sampling signals each having a sampling frequency of 125 Hz. The process of lowering the sampling speed is referred to as decimation. The order of the input samples incorporated into the decimation unit 71 is, as illustrated by an arrow, the reverse of the order of the arrangement of the polyphase filters 72-0 to 72-63. Namely, the first sampling signal is supplied to the bottom delay element ($Z^{-63}$) 71-63 the second sampling signal is supplied to the next delay element ($Z^{-62}$) 71-62 from the bottom, . . . , the 62-th sampling signal is supplied to the delay element ($Z^{-2}$) 71-2, the 63-th sampling signal is supplied to the top delay element ($Z^{-1}$) 71-1, the 64-th sampling signal is supplied, without passing through a delay element, directly to the polyphase filter ($H_0$) 72-0, and the 65-th sampling signal is again supplied to the bottom delay element ($Z^{-63}$) 71-63. The delay elements ($Z^{-1}$) 71-1 to ($Z^{-63}$) 71-63 are for delaying the phases of the input low-speed sampling signal, to coincide these phases with the phase of the sampling signal supplied to the top polyphase filter ($H_0$) 72-0.

The polyphase filters ($H_0$) 72-0 to ($H_{63}$) 72-63 and the 64-point IFFT 73 process the above-mentioned low-speed sampling signals so that, at the outputs of the IFFT 73, complex signals ch 1 to ch 31 each having a frequency arrangement as shown in FIG. 14B can be obtained. Here, each of the polyphase filters ($H_0$) 72-0 to ($H_{63}$) 72-63 passes one of the 64 sub-bands derived by splitting the voice band ranging from 0 to 8 kHz, and the IFFT 73 change the phase characteristics of the input sub-bands. At the outputs of the IFFT 74, 64 complex signals of the sub-bands ranging from 0 to 8 kHz are obtained, but the voice band is 0 to 4 kHz. Further, since a high frequency range higher than 3.6 kHz is unnecessary for actual communication, only 25 complex signals are permutated by the permutation unit 74, as shown in FIG. 13. These 25-point complex signals are, as illustrated in FIGS. 14C, arranged on the frequency domain ranging from 0 to 4 kHz.

The permuted complex signals are inputted to the IFFT 75, "0"s are inputted to the remaining inputs of the IFFT 75.

The IFFT 75, the polyphase filters 76-0 to 76-63, and the delay elements 77-1 to 77-63, carry out a processing operation that is the reverse of the processing in front of the permutation unit 74. The interleaving unit 78 synthesizes the sub-band signals in the normal order, as illustrated by an arrow, and thus, as illustrated in FIG. 14D, a scrambled output is obtained as a multiplexed or synthesized signal of a real part.

Since the digital signal processing in each unit is carried out after the conversion of the 8 kHz sampling signal into the low-speed sampling signal of 125 Hz by the decimation unit 71, the amount of signals to be processed in each unit inside the device can be made reduced.

Figure 15:
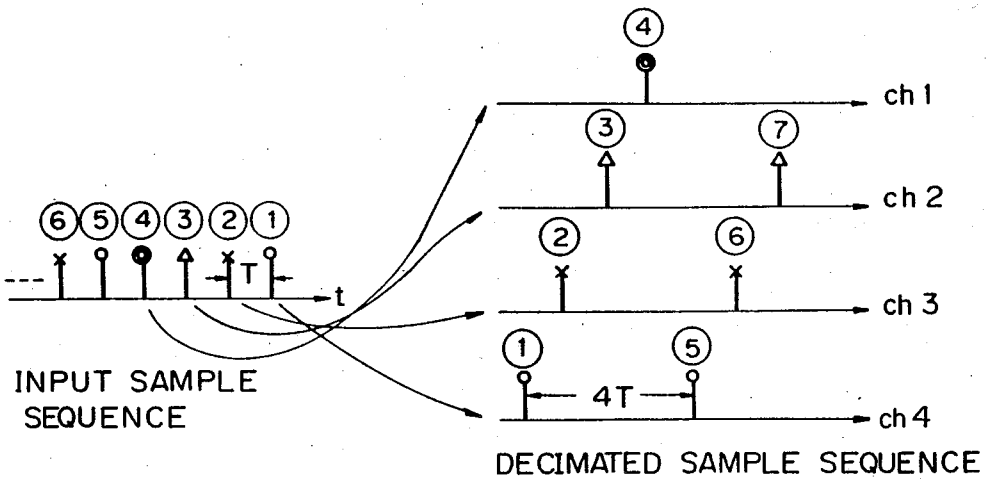
FIG. 15 is a diagram explaining the function of decimation.

FIG. 15 is a diagram explaining the function of the distribution or decimation. In the figure, as an example, the sampling speed is lowered to ¼. When a sequence of input samples ①, ②, ③, . . . arrive in the order shown at each time T, the decimation unit delivers the input samples ①, ⑤, ⑨, . . . to the last channel ch 4, the input samples ②, ⑥, . . . to the third channel ch 3, the input samples ③, ⑦, . . . to the second channel ch 2, and the input samples ④, ⑧, . . . to the first channel. As a result, the sample sequence in each channel has a period 4T, which means that the sampling speed is lowered to ¼ of the input sampling speed.

In FIG. 13, a fixed key is not necessary as the sub-band permutation key for scrambling.

Figure 16:
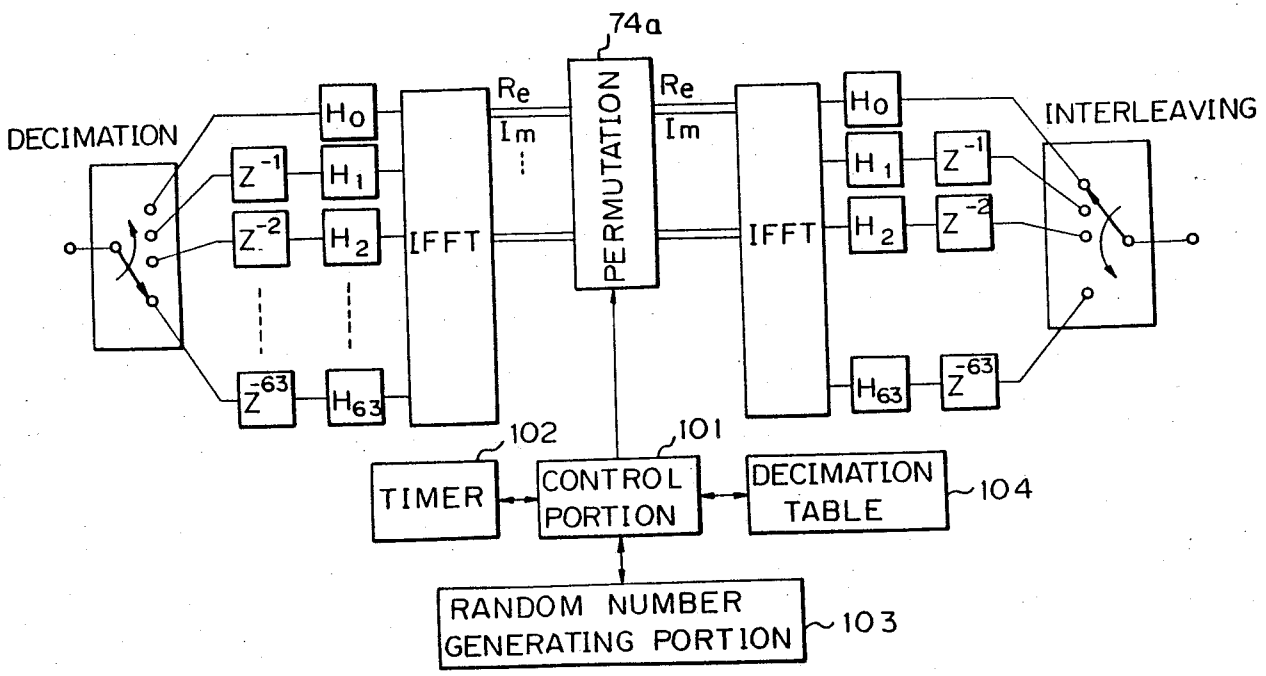
FIG. 16 is a block diagram illustrating a second embodiment of the present invention.

FIG. 16 shows a second embodiment of the present invention in which the permutation key in the permutation unit is changed in time. In the figure, a permutation unit **74*a* is controlled by a control unit 101, to which are connected a timer 102, a random number generating unit 103, and a permutation table 104. The remaining constitution of the equipment shown in FIG. 16 is the same as that of FIG. 13**.

Figure 17:
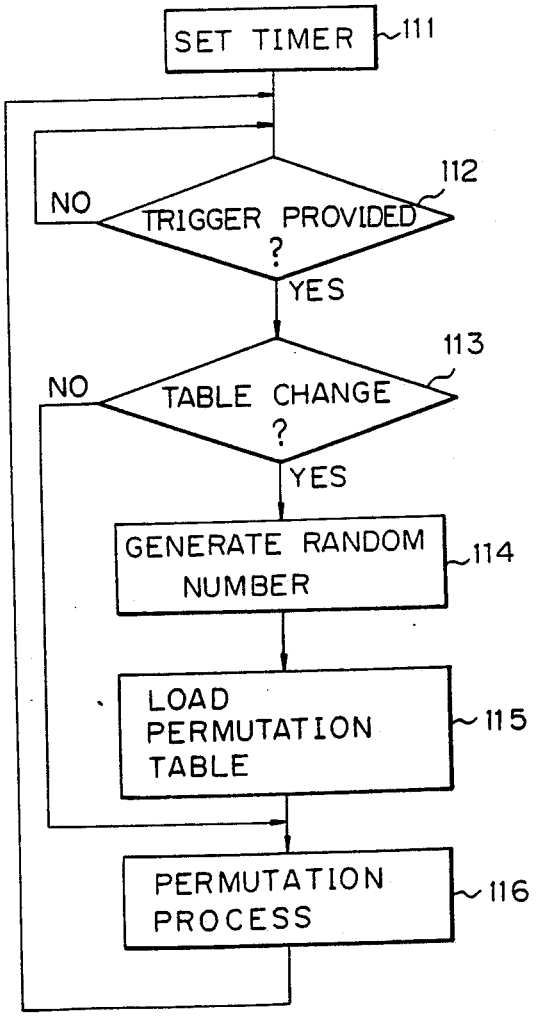
FIG. 17 is a flow chart for explaining the operation of the control portion in the equipment shown in FIG. 16.

FIG. 17 is a flow chart explaining the operation of the control unit 101 shown in FIG. 16. In FIGS. 16 and 17, at step 111, a predetermined time interval is set in the timer 102 for generating triggers, and at step 112, it is determined whether or not a trigger is provided by an interruption from the timer 102. If a trigger is provided, the control unit 101 recognizes that the predetermined time has passed and the process goes to a step 113, where it is determined whether or not the contents of the permutation table 104 should be changed. The change of the contents of the permutation table is carried out at every predetermined multiple of the time interval set in the timer 102. If the table is to be changed, the process goes to step 114, and if the table is not to be changed, the process goes to step 116. In step 114, the control unit 101 receives a random number from the random number generating unit 103 for looking up an address of the permutation table 104, and at step 115, the permutation table 104 is accessed to load permutation data by using the received random number as an address. Then, at a step 116, the permutation of sub-bands is carried out by using the permutation data as a key.

Figure 18:
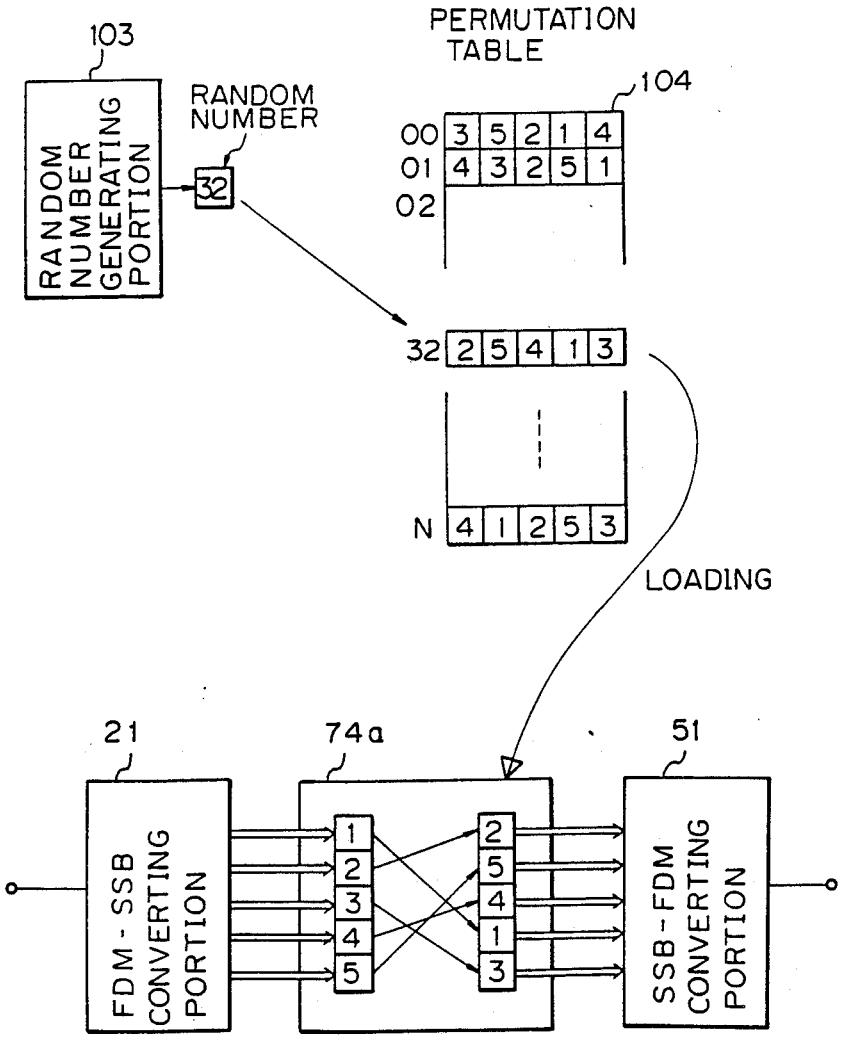
FIG. 18 is a diagram explaining an example of the operation of the steps 114 to 116 in the flow chart in FIG. 17.

FIG. 18 is a diagram explaining an example of the operation of the steps 114 to 116 in the flow chart in FIG. 17. In the figure, when the random number generating unit 103 generates a random number "32", the number "32" is used as an address so that a content "25413" at the address "32" is loaded into the control unit 101. The content "25413" is used as a key so that data "12345" inputted to the permutation unit **74*a* is permutated as "25413**".

Note that the front stage 21 and the rear stage 51 on either side of the permutation unit **74*a* shown in FIG. 18 are the same as those shown in FIG. 12 or in FIG. 13**.

Figure 19:
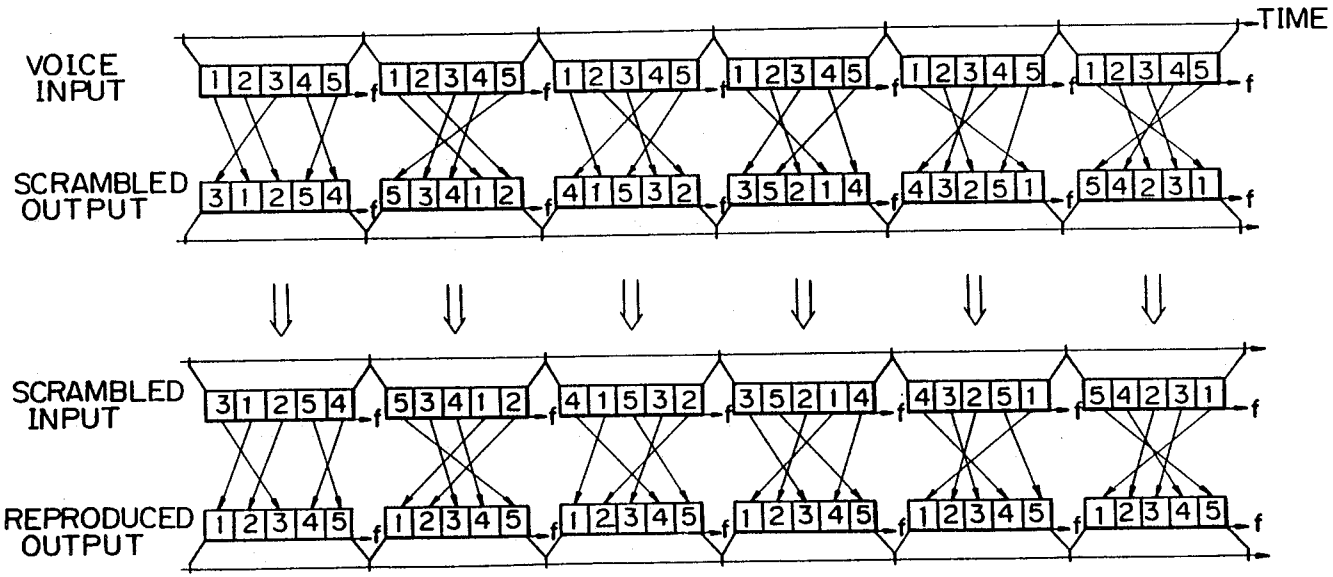
FIG. 19 is a diagram explaining the scrambling process by the method shown in FIG. 17.

FIG. 19 shows a change in time of scrambled signals with respect to the same input voice signal by the method shown in FIG. 18.

In the figure, the upper portion explains the change of scrambled voice at a transmitter side, and the lower portion explains the change of scrambled voice at a receiver side. At the transmitter side, with respect to the sub-band sequence "12345" of the input voice signal, the secret scrambled output sub-band sequence is changed in time, such as "31254", "53412", "35214", "43251", "54231", . . . At the receiver side, the scrambled input is decoded by a reverse processing to that used for the scrambling in the transmitter side, to obtain the original voice sound as a decoded output.

Figure 20:
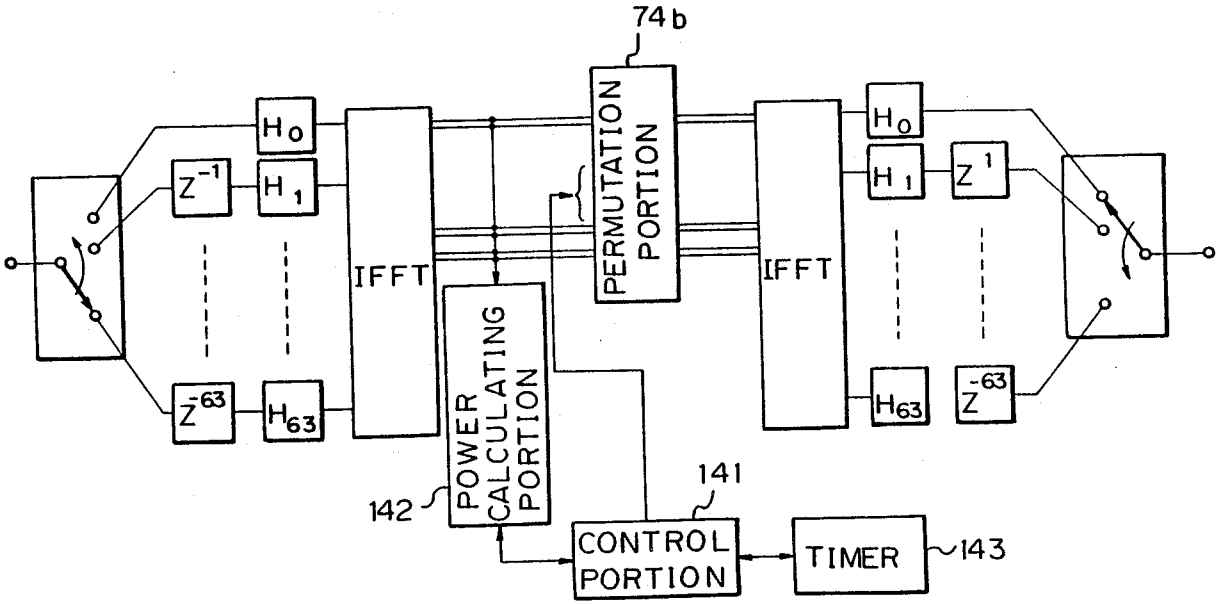
FIG. 20 is a block diagram illustrating a third embodiment of the present invention.

FIG. 20 is a block diagram of secret speech equipment according to the third embodiment of the present invention. In this embodiment, the power envelope of the scrambled voice signal is made constant to increase the level of secrecy. In the figure, a permutation unit **74*b* is controlled by a control unit 141, to which are connected a power calculator 142 and a timer 143. The remaining constitution is the same as the constitution of the equipment shown in FIG. 13. The power calculator 142 calculates the total power of the voice signal of respective channel signals which have been processed by the polyphase filters. The control unit 141 generates a signal power corresponding to the voice power calculated by the power calculator 142**, and, to make the total power constant, inserts dummy signals into an area of a voice band, such as an area of 1.8 kHz to 2.3 kHz, where the voice spectrum component is relatively small. The original signal can be obtained at the receiver side by deleting these dummy signals.

Figure 21:
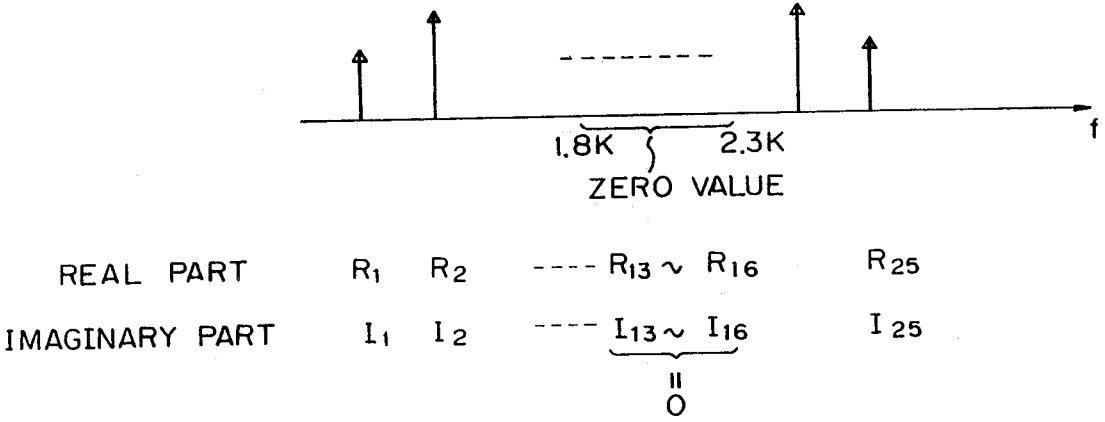
FIG. 21 is a diagram explaining a power calculation in the equipment shown in FIG. 20.

FIG. 21 is a diagram showing the method used for the power calculation in the power calculator 142. In the figure, the frequency spectrum of the voice band can be expressed by a real part $R_i$ and an imaginary part $I_i$. In the permutation unit **74*b***, a 25-point permutation is assumed to be carried out, and thus, i is a value from 1 to 25. Among the numbers, the frequency spectra $R_{13}$ to $R_{16}$ and $I_{13}$ to $I_{16}$ in the range from 1.8 kHz to 2.3 kHz, for example, are made zero, and dummy spectra are then inserted into the range. The voice power Pv before inserting the dummy spectra is expressed as:

$$Pv = \sum_{i=1}^{25} \sqrt{R_i^2 + I_i^2}$$

The power Pd of the dummy spectra is calculated to satisfy the relationship Pd=Pc−Pv, where Pc is a constant value, and thus, by inserting the dummy spectra, the power envelope is made constant. As an example of the dummy spectra, dummy spectra satisfying the relationship $$Pd = \sum_{i=13}^{16} \sqrt{R_i^2 + I_i^2}$$

are inserted.

Figure 22A:
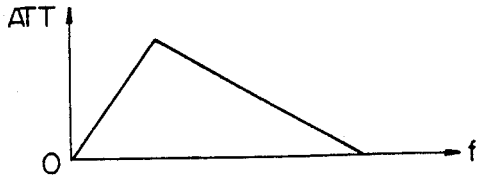
FIG. 22A to 22E are diagrams explaining the insertion and deletion of dummy spectra in the equipment shown in FIG. 20.
Figure 22B:
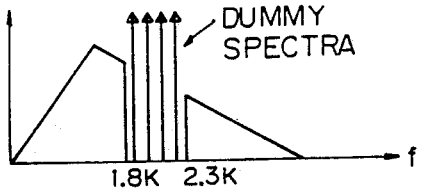
Figure 22C:
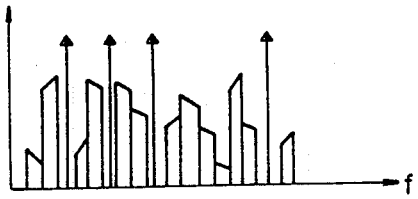
Figure 22D:
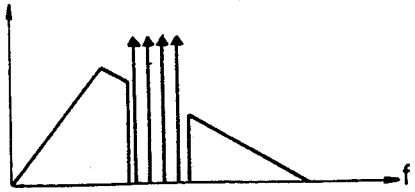
Figure 22E:
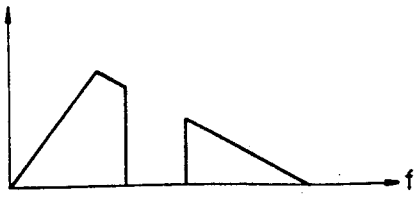

FIGS. 22A to 22E show the method for inserting or deleting dummy spectra. In these figures, the power in the range from 1.8 kHz to 2.3 kHz in the original voice band (FIG. 22A) is made zero and dummy spectra are inserted in the range (FIG. 22B). Then, the spectra of the sub-bands are permutated by the permutation unit **74*b* (FIG. 20), and a scrambled output signal is transmitted (FIG. 22C). At the receiver side, the spectra of the received signal are reversely positioned (FIG. 22D**), and then the band of the dummy spectra inserted in the range from 1.8 kHz to 2.3 kHz is made zero. As a result, almost all of the frequency spectra of the original voice band are reproduced as a decoded signal. Because of the presence of the zero value, the reproduced sound does not always faithfully reproduce the original sound, however, it is sufficient to listen.

By combining the second embodiment shown in FIG. 16 and the third embodiment shown in FIG. 20, the level of secrecy is further raised.

Figure 23:
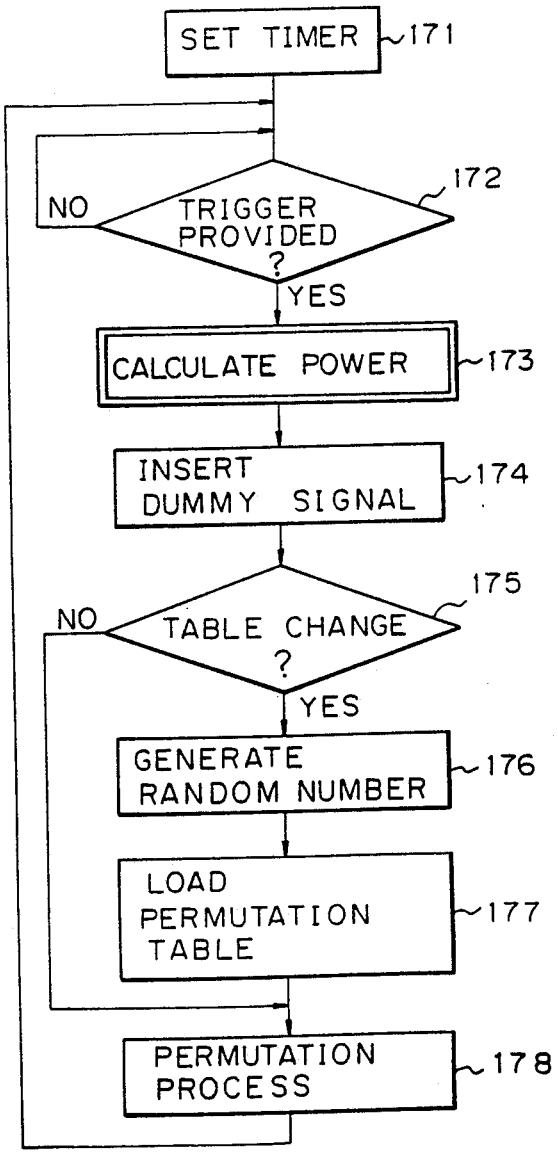
FIG. 23 is a flow chart explaining a constant envelope of power spectra.

FIG. 23 is a flow chart in which the flow chart of FIG. 17 and the steps for making a constant envelope of the power spectra of the third embodiment are incorporated. Among steps 171 to 178 in FIG. 23, only the added steps 173 and 176 are different from the steps of the flow chart shown in FIG. 17. In a calculation of a signal power in the step 173, the dummy band is made zero and the total power is then calculated. There are various methods of calculating the power, as follows.

Figure 24A:
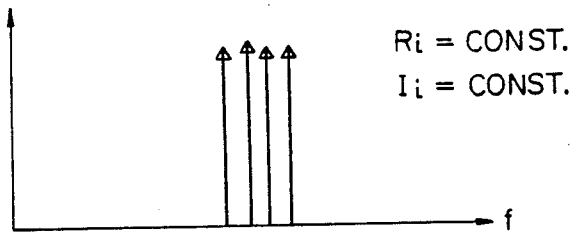
FIGS. 24A to 24C are diagrams illustrating various types of dummy spectra.
Figure 24B:
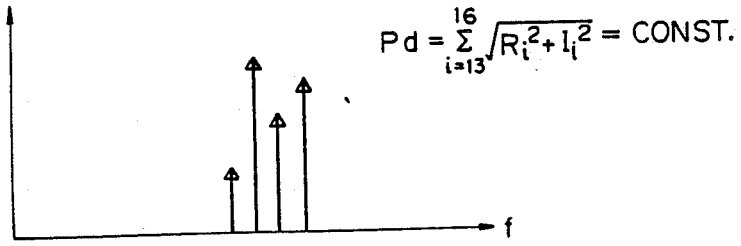
Figure 24C:
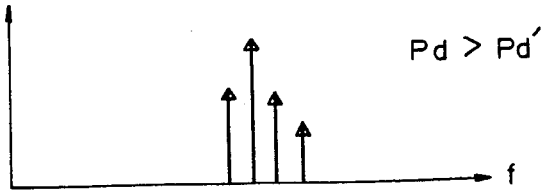

FIGS. 24A to 24C are diagrams illustrating the types of dummy spectra.

In FIG. 24A, the real part $R_i$ and the imaginary part $I_i$ of all of the dummy spectra are made constant; i.e., $R_{13}=R_{14}=R_{15}=R_{16}=R$ and $I_{13}=I_{14}=I_{15}=I_{16}=I$. In this case, the amplitudes of the dummy spectra for all frequencies are constant, and therefore, the level of secrecy is relatively low.

FIG. 24B shows an example in which the total power of the dummy spectra is made constant. Namely, $$Pd = \sum_{i=12}^{16} \sqrt{R_i^2 + I_i^2}$$

is made constant. $R_i$ and $I_i$ are generated by the random number generating unit, to satisfy the above equation.

In FIG. 24C, $R_i$ and $I_i$ are generated to satisfy the relationship Pd>Pd'; i.e., dummy spectra having a power Pd', which is smaller than the constant power Pd of the dummy spectra in the above-mentioned two methods shown in FIGS. 24A and 24B, are generated, and therefore, Pd' is expressed as $$Pd' = \sum_{i=13}^{16} \sqrt{R_i^2 + I_i^2}\ .$$

Figure 25:
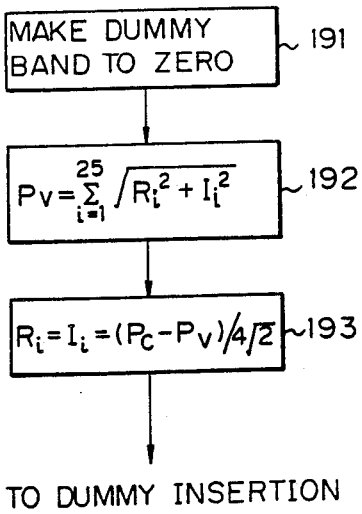
FIG. 25 is a flow chart explaining the method shown in FIG. 24A.

FIG. 25 is a flow chart explaining the power calculation method shown in FIG. 24A. In the figure, at step 191, the real part $R_{13}$ to $R_{16}$ and the imaginary part $I_{13}$ to $I_{16}$ of the spectra in the dummy band are made zero, and then, at step 192, the total power Pv of the sub-bands from 0 to 25 is then calculated as $$Pv = \sum_{i=1}^{25} \sqrt{R_i^2 + I_i^2}\ .$$

Then, at step 193, each value of each dummy spectrum is calculated. In this case, if Pc and Pv are constants, $R_i$ and $I_i$ of each dummy spectrum become constant. Namely, $R_i = I_i = (Pc - Pv)/\sqrt{2}$.

Figure 26:
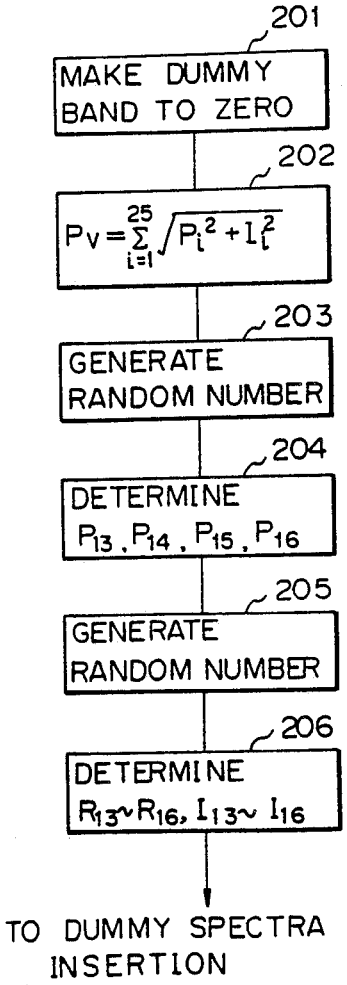
FIG. 26 is a flow chart explaining the method shown in FIG. 24B.

FIG. 26 is a flow chart explaining the power calculation method shown in FIG. 24B. In the figure, steps 201 and 202 are the same as steps 191 and 192 in FIG. 25. At step 203, random numbers ranging from 0 to 1.0 are generated three times, for example. Namely, when it is assumed that $Pd = P_{13} + P_{14} + P_{15} + P_{16}$, where $Pd = Pc - Pv$, the random number at the first time is, for example, $(P_{13} + P_{14})/(P_{15} + P_{16})$; the random number at the second time is, for example, $P_{13}/P_{14}$; and the random number at the third time is, for example, $P_{15}/P_{16}$. Based on these random numbers, at step 204, the power $P_{13}$, $P_{14}$, $P_{15}$, and $P_{16}$ of each dummy spectrum are calculated, and at step 205, random numbers ranging from 0 to 1.0 are generated four times, for example. Namely, when Pi is assumed as Pi=

$$\sqrt{R_i^2 + I_i^2}$$

(i=13 to 16), the random number at the first time is $R_{13}/I_{13}$; the random number at the second time is $R_{14}/I_{14}$; the random number at the third time is $R_{15}/I_{15}$; and the random number at the fourth time is $R_{16}/I_{16}$. Based on these random numbers, $R_{13}$ to $R_{16}$ and $I_{13}$ to $I_{16}$ are determined at step 206.

Figure 27:
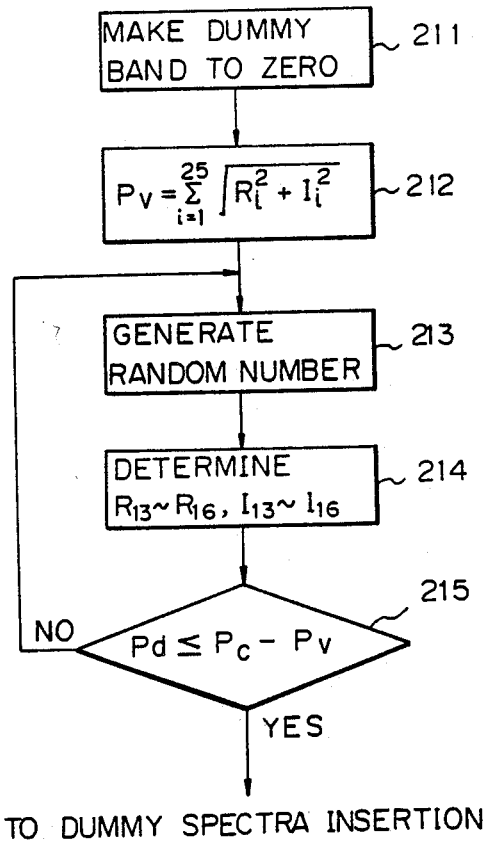
FIG. 27 is a flow chart explaining the method shown in FIG. 24C.

FIG. 27 is a flow chart explaining the power calculation method shown in FIG. 24C. In the figure, steps 211 and 212 are the same as steps 191 and 192 in FIG. 25. At step 213, random numbers are generated eight times, and at step 214, each random number is either one of the values $R_{13}$ to $R_{16}$ and $I_{13}$ to $I_{16}$, to determine the values $R_{13}$ to $R_{16}$ and $I_{13}$ to $I_{16}$. At step 215, $$Pd = \sum_{i=13}^{16} \sqrt{R_i^2 + I_i^2}$$

is calculated to determine whether or not the relationship $Pd \leqq Pc - Pv$ is satisfied, and if this relationship is satisfied, dummy spectra are inserted.

Figure 28:
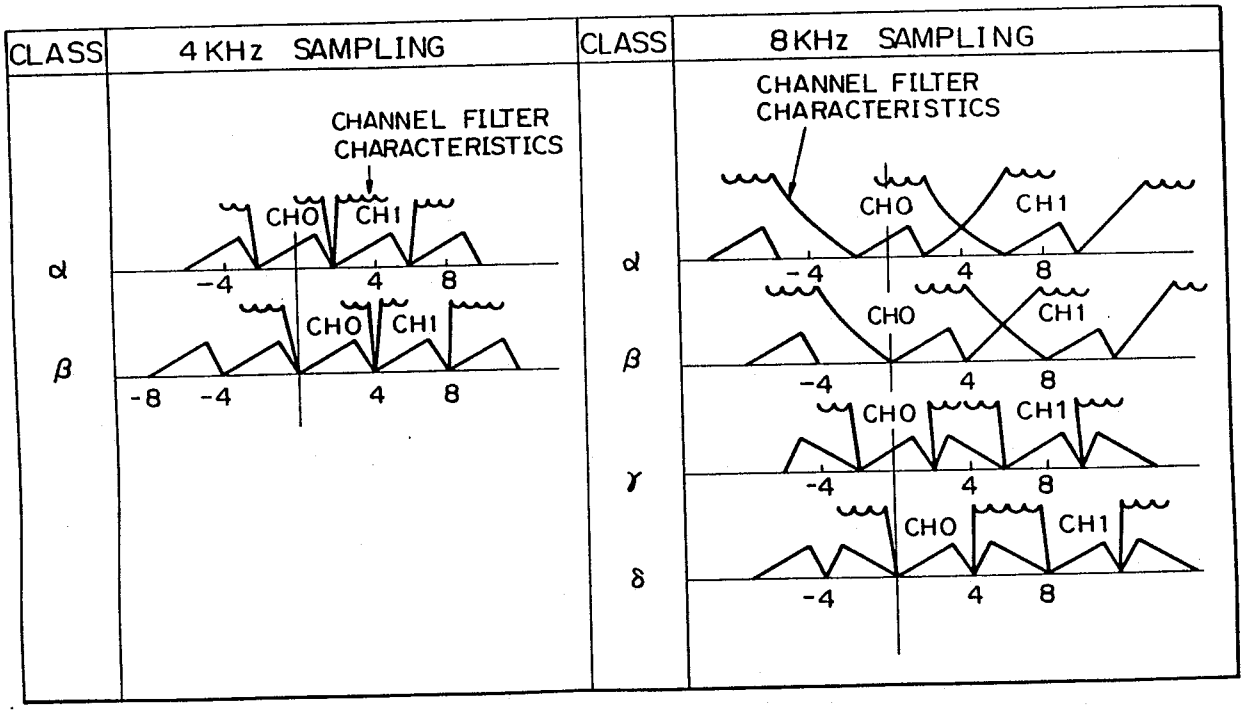
FIG. 28 is a diagram explaining typical examples of complex signal processings.

Note, the present invention is not restricted to the above-described embodiments. Namely, the present invention is provided by using a some T-MUX technology. The T-MUX technology can be classified into several types in accordance methods of producing complex signals. Namely, for a 4 kHz sampling, the T-MUXs are classified into two types, i.e., $\alpha$ type and $\beta$ type, and for the 8 kHz sampling, the T-MUXs are classified into four types, i.e., $\alpha$, $\beta$, $\gamma$, and $\delta$ types. Therefore, at present, six types of typical examples are known, as shown in FIG. 28. The Bellanger algorithm applied to the above-described embodiments is a T-MUX technology referred to as an $\alpha$ type of 4 kHz sampling. In the T-MUX of the $\alpha$ type of 4 kHz sampling, a Weaver modulation or Hartley modulation is carried out to obtain complex signals from real signals of an 8 kHz sampling. For example, by effecting the Weaver modulation of the $\alpha$ type by decimating 8 kHz samples, the frequency arrangement of the $\alpha$-type SSB complex signals of the Bellanger 4 kHz samples can be obtained.

The advantage of the 4 kHz sampling type is that the calculating process can be effected by 4 kHz, but the disadvantage thereof is that filters are necessary for the processes of making complex signals.

The advantages of the $\gamma$ and $\delta$ type 8 kHz sampling are that filters are not needed for making complex signals and the channel filter characteristics for making the FDM signals need not be sharp. The disadvantage of the 8 kHz sampling of the $\alpha$ and $\beta$ type is that a filter is necessary for making complex signals.

In these T-MUX units, the Bellanger 4 kHz sample $\alpha$-type is employed in the present invention because it requires only a relatively small number of calculations and the structure thereof is relatively simple. The secret speech equipment of the present invention, however, also may be constructed based on another type of T-MUX, such as the 4 kHz $\beta$ type, or 8 kHz $\alpha$, $\beta$, $\gamma$, or $\delta$ type.

From the foregoing description, it will be apparent that, according to the present invention, in a signal process in a secret speech equipment, the fast Fourier transform can be used and a multiphase sub-filtering process carried out on decimated signals so that the operation rates of respective filters can be reduced. As a result, the total amount of signal processing is remarkably reduced compared to the prior art digital filter bank system, thereby increasing the number of band divisions and raising the level of secrecy.

Further, the scrambling is carried out after deleting a part of the voice band and inserting a predetermined power into the deleted part, so that, even when the number of band splits is increased and the number of the digital filters is increased to obtain a high level secrecy, the tap number of each digital filter is reduced and the number of calculations for the signals to be treated is not increased.

We claim:

1. Secret speech equipment for ensuring secrecy of an analog voice signal by band split frequency scrambling of digital samples obtained after digital signal processing of the analog voice signal, comprising:

sub-band signal generating means, operatively receiving the digital samples, for treating the digital samples as frequency-multiplexed signals of voice spectra and for splitting said frequency-multiplexed signals into a plurality of frequency bands, to obtain sub-band signals of said frequency bands, each of said sub-band signals being arranged in a first sequence ordered by frequency of said frequency bands, said sub-band signal generating means comprising:

a plurality of bandpass filters having inputs and outputs;

distributing means, connected to said bandpass filters, for distributing digital samples as the inpúts to said plurality of bandpass filters; and inverse fast Fourier transformation means, connected to said bandpass filters, for applying different phase information to the outputs of said bandpass filters to obtain respective sub-band signals;

sub-band signal permutating means, connected to said sub-band signal generating means, for permutating the sequence of the sub-band signals obtained by said sub-band signal generating means; and sub-band signal multiplexing means, connected to said sub-band signal permutating means, for multiplexing the permutated sub-band signals.

2. Secret speech equipment as claimed in claim 1, wherein said sub-band signal permutating means comprises switching means for permutating said first sequence of the sub-band signals in a predetermined order, and for outputting permutated sub-band signals.

3. Secret speech equipment as claimed in claim 1, wherein said sub-band signal multiplexing means comprises:

extracting means for extracting a predetermined band signal from each of said sub-band signals to produce extracted band signals arranged in a second sequence ordered by frequency of the predetermined band signals;

delay means, connected to said extracting means, for delaying each of the extracted band signals for a predetermined time to produce delayed signals; and synthesizing means, connected to said delay means, for sequentially synthesizing the delayed signals.

4. Secret speech equipment as claimed in claim 1, further comprising:

control means for controlling said sub-band signal permutating means;

random number generating means for generating random numbers at a predetermined time;

a permutation table for storing permutation keys, accessed by the random numbers from said random number generating means and used in said sub-band signal permutation means as an exchanging key for said frequency bands.

5. Secret speech equipment as claimed in claim 1, wherein said sub-band signals are complex signals consisting of a reel part and an imaginary part, and wherein said secret speech equipment further comprises dummy spectrum inserting means for inserting dummy spectra into predetermined frequency bands in the complex signals inputted into said sub-band signal permutating means.

6. Secret speech equipment for ensuring speech secrecy by band split frequency scrambling of a signal having a predetermined frequency band including a voice band, comprising:

decimating means for decimating input sampling signals to produce sets of at least 2n samples of said input sampling signals, where n is a number of splits of said predetermined frequency band including the voice band;

signal output means for converting the at least 2n samples, obtained by decimation in said decimating means, into n frequency band signals, and for outputting the n frequency band signals;

permutating means for receiving, sequentially in a space domain, the n frequency and signals from said signal output means, and for changing an order of the n frequency band signals to provide permutated output signals sequentially in a frequency domain;

frequency band signal extracting means for extracting each frequency band signal from each of said permutated output signals; and interleaving means for multiplexing and synthesizing the frequency band signals extracted by said frequency band signal extracting means.

7. Secret speech equipment as claimed in claim 6, wherein:

said signal output means comprise complex signal output means including polyphase filters and an inverse fast Fourier transformer, for converting the at least 2n samples obtained by said decimating means into n complex frequency band signals having a real part and an imaginary part;

said permutating means permutates said complex frequency band signals;

said frequency band signal extracting means comprises means for extracting each frequency band signal from each of said complex frequency band signals after permutation by said permutating means; and said interleaving means comprises means for multiplexing and synthesizing the complex frequency band signals extracted by said frequency band signal extracting means.

8. Secret speech equipment as claimed in claim 6, further comprising:

control means for controlling said permutating means;

random number generating means for generating random numbers at a predetermined time;

a permutation table for storing permutation keys, accessed by the random numbers from said random number generating means and used in said permutating means as an exchange key for said frequency bands.

9. Secret speech equipment as claimed in claim 6, further comprising dummy spectra inserting means for inserting dummy spectra into predetermined frequency bands in frequency band signals inputted to said permutating means.

10. Secret speech equipment for ensuring speech secrecy by band split frequency scrambling of a signal having a predetermined frequency band including a voice band comprising:

decimation means for decimating input sampling signals to produce sets of at least 2n samples of said input sampling signals, where n is a number of splits of said predetermined frequency band including the voice band;

signal output means, including polyphase filters and an inverse fast Fourier transformer, for converter the at least 2n samples, obtained by decimation in said decimation means, into n complex frequency band signals, each having a real part and an imaginary part, and for outputting the n complex frequency band signals;

permutating means for receiving, sequentially in a frequency domain, the n complex frequency band signals from said signal output means, and for changing an order of the n complex frequency band signals to provide permutated output signals sequentially in a frequency domain;

frequency band signal extracting means for extracting each frequency band signal from each of said permutated output signals to produce extracted complex frequency band signals;

interleaving means for multiplexing and synthesizing the extracted complex frequency band signals.

11. Secret speech equipment for ensuring secrecy of an analog voice signal by band split frequency scrambling of digital samples obtained after digital signal processing of the analog voice signal, comprising:

decimation means for sequentially supplying every 2n samples of an input sampling signal having a period T in parallel outputs, each having a period nT;

2n first polyphase filters, each receiving one of the parallel outputs of said decimation means and passing one 1/(2n)-split frequency band of the analog voice signal, to produce outputs;

a first inverse fast Fourier transformer changing phase characteristics of the outputs of said polyphase filters to obtain complex signals, each being a 2n-multiplexed signal of a corresponding frequency band;

permutating means for permutating, in the frequency domain, frequency bands of the complex signals to produce outputs;

a second inverse fast Fourier transformer for applying an operation, reverse to that in said first fast Fourier transformer, to the outputs of said permutating means;

second polyphase filters, having substantially identical, characteristics as said first polyphase filters, connected to said second inverse fast Fourier transformer, producing output signals corresponding to the frequency bands in the outputs of said permutating means; and interleaving means for multiplexing and synthesizing the output signals of said second polyphase filters.

12. Secret speech equipment as claimed in claim 11, further comprising:

a control means for controlling said permutating means;

random number generating means for generating random numbers at a predetermined time; and a permutation table for storing permutation keys, accessed by the random numbers from said random number generating means and used in said sub-band signal permutating means as an exchange key for said frequency bands.

13. Secret speech equipment as claimed in claim 1, further comprising a dummy spectrum inserting means for inserting dummy spectra into predetermined frequency bands in the complex signals inputted to said permutating means.

14. Secret speech equipment as claimed in claim 13, wherein said dummy spectra have a constant amplitude.

15. Secret speech equipment as claimed in claim 12, wherein a sum of powers of said dummy spectra is constant.

* * * * *